US008748071B2

(12) United States Patent
Kojima et al.

(10) Patent No.: US 8,748,071 B2
(45) Date of Patent: Jun. 10, 2014

(54) IMAGE FORMING METHOD, TONER AND IMAGE FORMING APPARATUS

(75) Inventors: Satoshi Kojima, Numazu (JP); Toyoshi Sawada, Hiratsuka (JP); Tsuneyasu Nagatomo, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 597 days.

(21) Appl. No.: 12/273,870

(22) Filed: Nov. 19, 2008

(65) Prior Publication Data

US 2009/0142686 A1 Jun. 4, 2009

(30) Foreign Application Priority Data

Nov. 30, 2007 (JP) ..... 2007-310630
Oct. 7, 2008 (JP) ..... 2008-261101

(51) Int. Cl.
*G03G 9/00* (2006.01)
*G03G 15/08* (2006.01)

(52) U.S. Cl.
USPC ..... 430/108.7; 430/125.1; 399/111; 399/252

(58) Field of Classification Search
USPC ..... 430/108.7, 125.3; 399/252, 111
See application file for complete search history.

(56) References Cited

U.S. PATENT DOCUMENTS 6,717,602 B2 * 4/2004 Yamazaki et al. ..... 347/131
2006/0063081 A1 3/2006 Nagatomo et al.
2007/0065183 A1 * 3/2007 Tomita ..... 399/258
2007/0218381 A1 * 9/2007 Uchinokura et al. ..... 430/108.1
2007/0218383 A1 * 9/2007 Seshita et al. ..... 430/108.1
2007/0275315 A1 11/2007 Nagatomo et al.
2008/0070144 A1 3/2008 Nagatomo et al.

FOREIGN PATENT DOCUMENTS

JP 3872506 10/2006
JP 2007-79504 3/2007
JP 2007-86093 A 4/2007
JP 2007-133267 A 5/2007
JP 2007-272205 A 10/2007
JP 2007-279715 A 10/2007
JP 2007-286078 A 11/2007

OTHER PUBLICATIONS

Japanese Office Action issued Dec. 18, 2012 in Patent Application No. 2008-261101.

* cited by examiner

*Primary Examiner* — Thorl Chea
(74) *Attorney, Agent, or Firm* — Oblon, Spivak, McClelland, Maier & Neustadt, L.L.P.

(57) ABSTRACT

To provide an image forming method including conveying a toner by means of a toner supply device that supplies the toner from inside a toner housing container into a developer housing section of a developing device with the use of a screw pump, and forming an image on a recording medium by developing a latent image on a latent image bearing member to form a toner image with the use of a developer and by transferring the toner image to the recording medium by means of a transfer device, wherein the toner is formed by adding small particle size silica to toner base particles, and wherein when A represents the average degree of circularity of the toner, and B, expressed as percent by mass, represents the amount of the small particle size silica relative to the mass of the toner base particles, the expression $-18A+17.92 \leq B \leq -34A+33.96$ is satisfied.

14 Claims, 6 Drawing Sheets

IMAGE FORMING METHOD, TONER AND IMAGE FORMING APPARATUS

BACKGROUND OF THE INVENTION

1. Field of the Invention

The present invention relates to an image forming method used in an image forming apparatus such as a copier, a facsimile, a printer, etc.; a toner used in an image forming apparatus; and an image forming apparatus using the toner.

2. Description of the Related Art

As a toner supply device that supplies toner in a toner storage container to a developer housing section of a developing device in an image forming apparatus, there has conventionally been a toner supply device in which toner is conveyed using a screw pump, as described in Japanese Patent (JP-B) No. 3872506 or Japanese Patent Application Laid-Open (JP-A) No. 2007-079504. Such a toner supply device is equipped with a conveyance path member through which toner passes, and a screw pump; toner in the toner storage container is conveyed to the developer housing section by the suction of the screw pump.

The screw pump is provided with a stator which is a cylindrical elastic member having a spiral groove in its inner wall surface, and a rotor which is a spiral metal member that rotates inside the stator. Between the stator and the rotor, there is formed an enclosed space surrounded by their surfaces and contact portions where they are in contact with each other; as the rotor rotates, it slides and rubs on the stator, and this rotation causes the portion of the rotor in contact with the stator to move, thereby making the enclosed space move in the rotational axis direction of the rotor. The screw pump is provided with opening portions at both its ends with respect to the rotational axis direction of the rotor, and the opening portion on the upstream side in the moving direction of the enclosed space serves as a suction opening, whereas the opening portion on the downstream side in the moving direction of the enclosed space serves as an outlet. The suction opening is connected to the toner storage container via a conveyance tube that is a conveyance path member, and the outlet is connected to the developer housing section of the developing device directly or via a conveyance path member or a hopper member.

In the toner supply device equipped with the screw pump, when the screw pump is driven, negative pressure is generated at the suction opening due to the movement of the enclosed space caused by the rotation of the rotor, and toner in the toner storage container is sucked and thusly enters between the stator and the rotor of the screw pump. The toner having entered the screw pump is enclosed between the stator and the rotor due to the movement of the contact portions of the stator and the rotor caused by the rotation of the rotor, then the toner is conveyed to the outlet by the movement of the enclosed space. The toner having been discharged from the outlet of the screw pump is supplied to the developer housing section directly or via the conveyance path member or the hopper member.

In the foregoing toner supply device equipped with the screw pump, since toner is conveyed by the suction of the screw pump, it is possible to convey the toner even if the conveyance tube is curved at a steep angle or ascends at a steep angle, for instance. Therefore, use of the screw pump makes it possible to increase the degree of freedom of the layout of the toner supply device. Also, it is possible to place a conveyance tube between components in the vicinity of the toner supply device and thus to make an image forming apparatus compact.

In the screw pump, however, since toner is conveyed with the contact portion of the rotor and the contact portion of the stator rubbing against each other, the toner is given stress attributable to frictional heat, shearing force, pressure, etc. in gaps between the rotor and the stator, which exist at the contact portions, and thus toner aggregates of 0.1 mm to 1 mm in diameter are produced in some cases. The cohesion of these aggregates is weak to such an extent that they crumble when touched by fingertips; thus, some of the aggregates are broken into fine pieces through agitation by an agitating member inside the developer housing section and come back into the state of ordinary toner powder even if supplied to the developing device along with other toner. In some cases, however, some others of the aggregates with higher cohesiveness are not broken into fine pieces inside the developer housing section and thusly supplied to a developing roller that supplies toner to a latent image on the surface of a photoconductor. Once the aggregates supplied to the developing roller have been supplied onto the photoconductor surface, they can no longer be broken into fine pieces. When these aggregates are transferred from the photoconductor to a recording medium such as transfer paper by a transfer device, image defect is caused. For instance, in the case of a solid image (in which a single color is used and the amount of toner attached is 0.45 $mg/cm^2$), an abnormal image (hereinafter referred to as "firefly") is produced in which a deep color spot is formed at the part where the aggregates have been attached, and a pale color area is formed in the vicinity of the deep color spot. Meanwhile, in the case of a linear image, the part where the aggregates have been attached blackens, and thus thin lines may be unable to be reproduced.

To prevent the image defect which stems from the formation of aggregates, it is required that toner particles not easily adhere to one another by electrostatic or nonelectrostatic adhesion and that the cohesiveness of the toner particles not exceed a predetermined level, in other words constant fluidity of the toner particles be maintained, even after stress attributable to heat, pressure, etc. has been applied to the toner particles inside the screw pump.

In maintaining constant fluidity of toner particles, the degree of circularity of the toner particles and the amount of an external additive, which affect the fluidity of the toner particles, are important factors. The closer the degree of circularity of toner particles is to 1.0, in other words the closer they are to spheres in shape, the higher their fluidity is. Conversely, the more the degree of circularity of toner particles deviates from 1.0, in other words the more they deform, the lower their fluidity is. Meanwhile, as for fine silica particles (hereinafter referred to as "small particle size silica") having a BET specific surface area of approximately 50 $m^2/g$ to 400 $m^2/g$ commonly used as an external additive for toner, the larger their amount is, the higher the fluidity of toner particles is. Conversely, the smaller their amount is, the lower the fluidity of toner particles is. This is because nonelectrostatic adhesion between the toner particles can be reduced to a greater extent, as the degree of circularity of the toner particles is made closer to 1.0 or the fine silica particles are added in larger amounts. Accordingly, by making toner particles closer to spheres in shape or increasing the amount of small particle size silica added, it is possible to enhance the fluidity of the toner particles.

However, when the small particle size silica is excessively added, the following troubles arise in some cases. When the small particle size silica is added in larger amounts than necessary to toner base particles having a high degree of circularity, such a trouble is caused that there is a tremendous increase in fluidity and thus an excessive increase in the bulk density of the toner. There is a device for optimizing the toner concentration in a developer by means of a judgment based upon the bulkiness of the developer, made by a sensor provided in a developing device. In the foregoing device, when the bulk density of the developer is excessively high, the toner concentration is most suitable, but the sensor is likely to judge that the concentration of developer components other than the toner is higher than the toner concentration, and so the toner may be excessively supplied, thereby possibly leading to an extremely high toner concentration as a result.

Meanwhile, when an attempt is made to rectify the poor fluidity of toner particles having a low degree of circularity by merely adding the small particle size silica, it needs to be added in large amounts, and thus the proportion of the small particle size silica to the toner base particles becomes high. As the proportion of the small particle size silica to the toner base particles becomes high, the toner-fixing property degrades. Moreover, in the case where a cleaning device for removing toner on the surface of a toner image bearing member such as a photoconductor removes the toner by means of a blade, the blade is often partially abraded if a high proportion of small particle size silica is contained in the toner to be removed. When the blade of the cleaning device is partially abraded, such a cleaning defect is caused in which toner remains in the form of a streak on a part of the toner image bearing member surface facing the abraded part of the blade, and this cleaning defect leads to an image defect in which a black streak appears in an image formed on a recording medium. Prevention of the occurrence of such troubles caused by excessive addition of small particle size silica necessitates optimizing the degree of circularity of toner base particles and the amount of small particle size silica added.

BRIEF SUMMARY OF THE INVENTION

Designed in light of the present situation described above, the present invention is aimed at solving problems in related art and achieving the following object. An object of the present invention is to provide an image forming method which includes forming an image by supplying a toner to a developing device with the use of a screw pump, and which is capable of preventing the occurrence of image defect that stems from formation of toner aggregates inside a screw pump and also preventing the occurrence of trouble that stems from excessive addition of small particle size silica; a toner used in the image formation; and an image forming apparatus using the toner.

Means for solving the problems are as follows.

<1> An image forming method including conveying a toner by means of a toner supply device that supplies the toner from inside a toner housing container, which houses the toner, into a developer housing section of a developing device, which houses a developer, with the use of a screw pump, and forming an image on a recording medium by developing a latent image on a latent image bearing member to form a toner image with the use of the developer and by transferring the toner image formed on the latent image bearing member to the recording medium by means of a transfer device, wherein the toner is formed by adding small particle size silica to toner base particles, and wherein when A represents the average degree of circularity of the toner, and B, expressed as percent by mass, represents the amount of the small particle size silica relative to the mass of the toner base particles, Expression (1) shown below is satisfied.

$$-18A+17.92 \leq B \leq -34A+33.96 \quad \text{Expression (1)}$$

<2> The image forming method according to <1>, wherein the toner includes at least a binder resin, a colorant, a releasing agent, and a modified layered inorganic mineral in which at least part of interlayer ions are modified with organic ions.

<3> The image forming method according to <2>, wherein the toner is obtained by dissolving and/or dispersing in an organic solvent at least the binder resin, a prepolymer derived from a modified polyester resin, a compound capable of elongating and/or cross-linking with the prepolymer, the colorant, the releasing agent and the modified layered inorganic mineral so as to prepare a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction.

<4> The image forming method according to <3>, wherein the modified layered inorganic mineral occupies 0.05% by mass to 10% by mass of a solid content of the solution or the dispersion liquid.

<5> The image forming method according to any one of <1> to <4>, wherein the small particle size silica in the toner has a BET specific surface area of 50 $m^2/g$ to 400 $m^2/g$, and the average degree of circularity A of the toner satisfies the expression $0.94 \leq A \leq 0.99$.

<6> The image forming method according to any one of <1> to <5>, wherein the toner has a volume average particle diameter (Dv) of 3 μm to 8 μm, and a ratio (Dv/Dn) of the volume average particle diameter (Dv) to a number average particle diameter (Dn) of the toner is in the range of 1.00 to 1.30.

<7> The image forming method according to any one of <1> to <6>, wherein in the toner, particles of 2 μm or less in diameter occupy 1% by number to 10% by number of all particles.

<8> A toner formed by adding small particle size silica to toner base particles, wherein when A represents the average degree of circularity of the toner, and B, expressed as percent by mass, represents the amount of the small particle size silica relative to the mass of the toner base particles, Expression (1) shown below is satisfied, and $$-18A+17.92 \leq B \leq -34A+33.96 \quad \text{Expression (1)}$$

wherein the toner is used in an image forming method which includes conveying the toner by means of a toner supply device that supplies the toner from inside a toner housing container, which houses the toner, into a developer housing section of a developing device, which houses a developer, with the use of a screw pump, and forming an image on a recording medium by developing a latent image on a latent image bearing member to form a toner image with the use of the developer and by transferring the toner image formed on the latent image bearing member to the recording medium by means of a transfer device.

<9> The toner according to <8>, including at least a binder resin, a colorant, a releasing agent, and a modified layered inorganic mineral in which at least part of interlayer ions are modified with organic ions.

<10> The toner according to <9>, obtained by dissolving and/or dispersing in an organic solvent at least the binder resin, a prepolymer derived from a modified polyester resin, a compound capable of elongating and/or cross-linking with the prepolymer, the colorant, the releasing agent and the modified layered inorganic mineral so as to prepare one of a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction.

<11> The toner according to <10>, wherein the modified layered inorganic mineral occupies 0.05% by mass to 10% by mass of a solid content of the solution or the dispersion liquid.

<12> The toner according to any one of <8> to <11>, wherein the small particle size silica has a BET specific surface area of 50 $m^2/g$ to 400 $m^2/g$, and the average degree of circularity A of the toner satisfies the expression $0.94 \leq A \leq 0.99$.

<13> The toner according to any one of <8> to <12>, having a volume average particle diameter (Dv) of 3 μm to 8 μm, wherein a ratio (Dv/Dn) of the volume average particle diameter (Dv) to a number average particle diameter (Dn) of the toner is in the range of 1.00 to 1.30.

<14> The toner according to any one of <8> to <13>, wherein particles of 2 μm or less in diameter occupy 1% by number to 10% by number of all particles.

<15> An image forming apparatus including a latent image bearing member, a developing device which develops a latent image on the latent image bearing member, using a developer housed in a developer housing section of the developing device, a toner housing container which houses a toner to be supplied to the developer in the developer housing section, a toner supply device which supplies the toner in the toner housing container to the developer housing section of the developing device with the use of a screw pump, a transfer unit configured to transfer onto a recording medium a toner image formed on the latent image bearing member through development by the developing device, and a fixing unit configured to fix the toner image on the recording medium onto which the toner image has been transferred, wherein the toner is the toner according to any one of <8> to <14>.

<16> The image forming apparatus according to <15>, wherein the latent image bearing member and at least one selected from the developing device, a charging device which charges the latent image bearing member, and a cleaning device which cleans a surface of the latent image bearing member after transfer of the toner image are integrally supported and formed as a process cartridge that is detachably mountable to an image forming apparatus main body.

As a result of experiments performed by the present inventors, which are to be later explained with reference to Tables 1 and 2 and FIG. 6, the following has been found: in the case where A and B satisfy the expression $-18A+17.92 \leq B \leq -34A+33.96$ (A denotes the average degree of circularity of a toner, and B, expressed as percent by mass, denotes the amount of small particle size silica relative to the mass of toner base particles) when an image is formed by supplying a toner to a developing device with the use of a screw pump, it is possible to prevent the occurrence of cleaning defect and a rise in bulk density caused by excessive addition of small particle size silica and also to prevent the occurrence of fireflies caused by formation of toner aggregates.

The present invention offers a superior effect of preventing the occurrence of image defect that stems from formation of toner aggregates inside a screw pump and also preventing the occurrence of trouble that stems from excessive addition of small particle size silica.

DETAILED DESCRIPTION OF THE INVENTION

The following explains an embodiment in which the present invention has been applied to an electrophotographic copier (hereinafter simply referred to as "copier 100C") that is an electrophotographic image forming apparatus.

Figure 1:
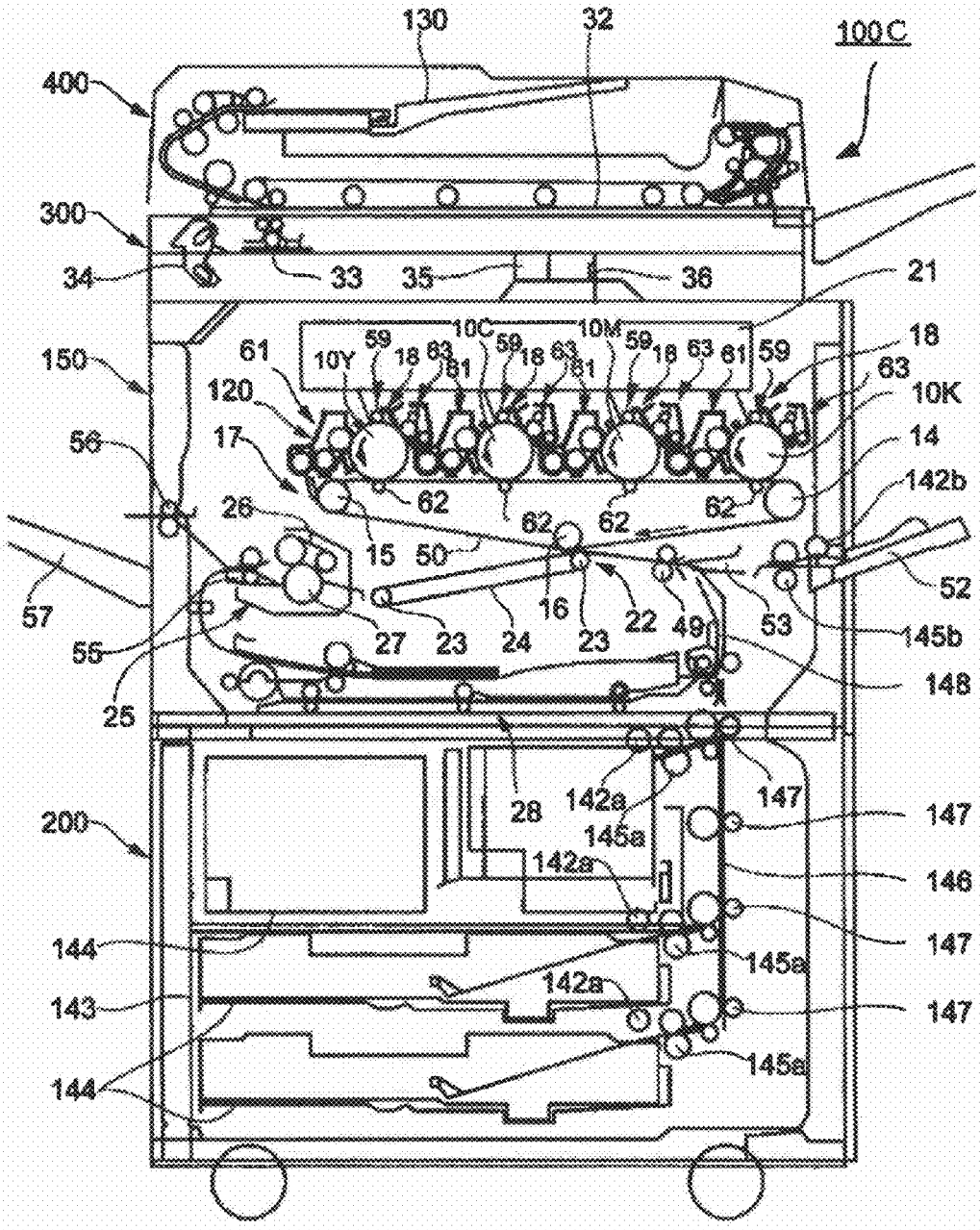
FIG. 1 is a schematic structural diagram of a copier according to the present embodiment.

FIG. 1 is a schematic structural diagram showing the copier 100C. The copier 100C is a tandem-type color copier. The copier 100C includes an image forming unit 150, a paper feed table 200, a scanner 300 and an automatic document feeder 400.

At the center of the image forming unit 150, an intermediate transfer belt 50, which is an intermediate transfer member in the form of an endless belt, is provided. The intermediate transfer belt 50 is supported by supporting rollers 14, 15 and 16 so as to be able to move clockwise in the figure. An intermediate transfer member cleaner 17 for removing toner that remains on the intermediate transfer belt 50 is placed in a position in which to face the supporting roller 15 with the intermediate transfer belt 50 situated in between. Over the intermediate transfer belt 50 supported by the supporting rollers 14 and 15, a tandem-type image forming unit 120 in which image producing sections 18 for forming images of yellow, cyan, magenta and black respectively are arranged so as to face one another is placed along the conveyance direction of the intermediate transfer belt 50.

An exposer 21 is placed above the image forming unit 120. On the side of the intermediate transfer belt 50 opposite to the side where the image forming unit 120 is placed (in other words, under the intermediate transfer belt 60), a secondary transfer device 22 is placed. In this secondary transfer device 22, a secondary transfer belt 24, which is an endless belt, is supported by a pair of rollers 23.

The secondary transfer belt 24 and the intermediate transfer belt 50 come into contact with each other to form a secondary transfer nip, at a portion where the supporting roller 16 faces the roller 23 situated on the upstream side in the paper conveyance direction of the secondary transfer belt 24. Transfer paper as a recording medium, which is conveyed on the secondary transfer belt 24, and the intermediate transfer belt 50 can come into contact with each other at the secondary transfer nip. A fixing device 25 is placed on the downstream side in the paper conveyance direction of the secondary transfer device 22. The fixing device 25 includes a fixing belt 26, which is an endless belt, and a pressurizing roller 27 placed so as to press against the fixing belt 26.

Additionally, in the copier 100C, a sheet reversing device 28 for reversing transfer paper is placed below the secondary transfer device 22 and the fixing device 25. This makes it possible for a sheet of transfer paper with an image formed on its one surface to be conveyed toward the secondary transfer nip such that an image is formed on its other surface as well, and thus it is possible to form images on both surfaces of the sheet of the transfer paper.

Figure 2:
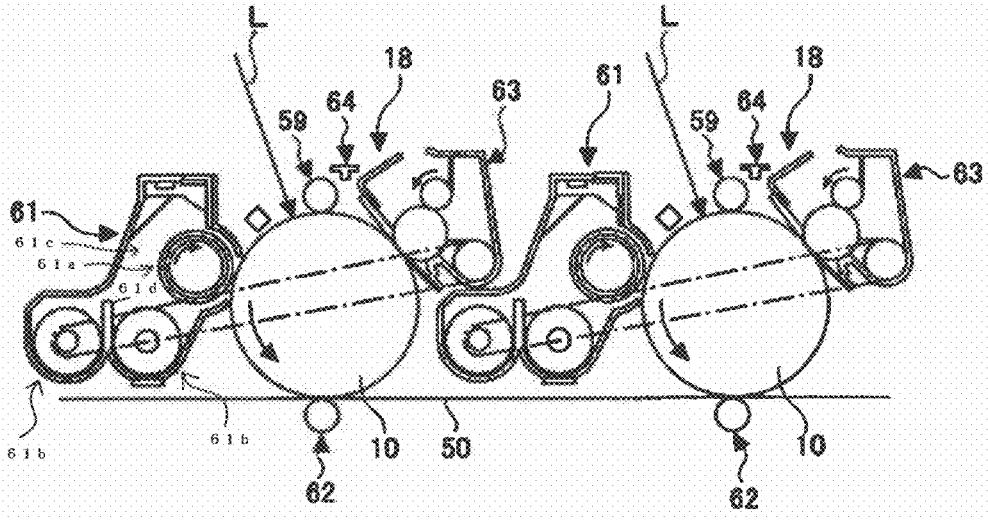
FIG. 2 is a partially enlarged explanatory diagram showing part of a tandem section composed of four image producing sections provided in an image forming unit.

FIG. 2 is a partially enlarged diagram showing part of a tandem section composed of the four image producing sections 18 provided in the image forming unit 120.

As shown in FIG. 2, in each of the image producing sections 18 of the image forming unit 120, there are provided a charger 59, a developing device 61, a transfer charger 62, a photoconductor cleaner 63 and a charge eliminator 64 around a photoconductor 10. In each image producing section 18, the surface of the photoconductor 10 is uniformly charged by the charger 59, the exposer 21 applies an exposure light L to the uniformly charged surface of the photoconductor (latent image bearing member) 10 based upon image-related information for the corresponding color, and thus a latent electrostatic image is formed on the surface of the photoconductor 10.

Then toner images of each color are formed on the photoconductors 10 by developing the latent electrostatic images with the use of toners of each color housed in the developing devices 61. The toner images formed on the photoconductors 10 are transferred onto the intermediate transfer belt 50 by means of transfer biases generated between the transfer chargers 62 and the photoconductors 10. After the toner images have been transferred onto the intermediate transfer belt 50, residual toner is removed from the surfaces of the photoconductors 10 by the photoconductor cleaners 63, and preparations for a subsequent image producing process are made as charge is eliminated from the surfaces of the photoconductors 10 by the charge eliminators 64.

In the copier 100C, the photoconductor 10, the charger 59, the developing device 61 and the photoconductor cleaner 63 constituting each image producing section 18 are integrally supported and formed as a process cartridge that is detachably mountable to the main body of the copier 100C.

Next, formation of a full-color image (color copy) with the copier 100C will be explained. First of all, a document is set on a document stand 130 of the automatic document feeder 400; alternatively, a document is set on a contact glass 32 of the scanner 300 by opening the automatic document feeder 400, then the automatic document feeder 400 is closed.

When a start switch (not shown) is pushed, the following takes place: in the case where the document is set on the automatic document feeder 400, the scanner 300 is driven after the document has been conveyed onto the contact glass 32; in the case where the document is set on the contact glass 32, the scanner 300 is driven immediately. Then a first carriage 33 and a second carriage 34 move. On this occasion, light that has been applied by the first carriage 33 and subsequently reflected from the document surface is then reflected by a mirror of the second carriage 34 and received by a reading sensor 36 through an image forming lens 35. Thus, the color document (color image) is read, and image-related information for black, yellow, magenta and cyan is produced.

The image-related information for each color is transmitted to the exposer 21 in the image forming unit 150, then exposure light based upon the image-related information for each color is applied to the photoconductors 10 of each color so as to form latent images thereon, and toner images of each color are formed on the photoconductors 10 by supplying the toners of each color from the developing devices 61 to these latent images. When the toner images have been formed on the photoconductors 10 of each color, the toner image on a photoconductor 10Y for yellow, the toner image on a photoconductor 10C for cyan, the toner image on a photoconductor 10M for magenta and the toner image on a photoconductor 10K for black are sequentially transferred (primarily transferred) onto the intermediate transfer belt 50. On the intermediate transfer belt 50, a four-color image is formed by superimposing the toner images of each color onto each other.

As for the paper feed table 200, one of paper feed rollers 142*a* is selectively rotated so as to eject sheets of transfer paper from one of multiple paper feed cassettes 144 provided in a paper bank 143. The sheets of the transfer paper ejected from the one of the multiple paper feed cassettes 144 are separated from one another by a separation roller 145*a* and sent one by one to a paper feed path 146, then the sheets are conveyed by a conveyance roller 147 to a paper feed path 148 in the image forming unit 150 and made to hit a resist roller 49 to stop. Alternatively, a manual bypass paper feed roller 142*b* is rotated so as to feed sheets of transfer paper installed on a manual bypass tray 52, the sheets are separated from one another by a manual bypass separation roller 145*b* and sent one by one to a manual bypass paper feed path 53, and the sheets are similarly made to hit the resist roller 49 to stop. Additionally, the resist roller 49, which is generally grounded when used, may be used with a bias being applied thereto so as to remove paper dust from the sheets.

By rotating the resist roller 49 in a manner that corresponds to the conveyance of the four-color image formed on the intermediate transfer belt 50, and thusly sending the transfer paper between the intermediate transfer belt 50 and the secondary transfer device 22, the four-color image is formed on the transfer paper. Note that toner remaining on the intermediate transfer belt 50 after the transfer is removed by the intermediate transfer member cleaner 17.

The transfer paper on which the four-color image has been formed is conveyed by the secondary transfer device 22 to the fixing device 25 where the four-color image is fixed onto the transfer paper by heat and pressure. Thereafter, the moving direction of the transfer paper is changed by a switching claw 55, and the transfer paper is discharged by a discharging roller 56 and then stacked on a paper discharge tray 57. Alternatively, the moving direction of the transfer paper is changed by the switching claw 55, and the transfer paper is conveyed to the sheet reversing device 28 where it is reversed, and guided again to the transfer position in order that an image is formed also on the back surface thereof, then the transfer paper is discharged by the discharging roller 56 and stacked on the paper discharge tray 57.

An image forming method to which the present invention can be applied includes a latent electrostatic image forming step (a charging step and an exposing step), a developing step, a transfer step, a fixing step and a cleaning step, and may further include steps such as a charge eliminating step, a recycling step and a controlling step in accordance with the necessity.

The latent electrostatic image forming step is a step of forming a latent electrostatic image on an image bearing member. The material, form, structure, size and the like of the image bearing member can be suitably selected from those of known image bearing members. Examples of the material include inorganic materials such as amorphous silicon and selenium, and organic materials such as polysilane and phthalopolymethine, with amorphous silicon being preferable for its long lifetime. The shape is preferably a drum-like shape. The latent electrostatic image can be formed by uniformly charging the surface of the image bearing member and then exposing the surface imagewise, which can be performed by a latent electrostatic image forming unit. The latent electrostatic image forming unit preferably includes a charger (charging unit) to charge the surface of the image bearing member uniformly, and an exposer (exposing unit) to expose the surface of the image bearing member.

The charging can be performed by applying a voltage to the surface of the image bearing member, using the charger. The charger may be suitably selected in accordance with the intended use, and examples thereof include known contact-type chargers such as those provided with conductive or semi-conductive rolls, brushes, films, rubber blades, etc., and non-contact type chargers utilizing corona discharge, such as corotron chargers and scorotron chargers.

The exposure can be performed by exposing the surface of the image bearing member, using the exposer. The exposer may be suitably selected in accordance with the intended use, and examples thereof include exposers that employ a copying optical system, a rod lens array system, a laser optical system, a liquid crystal shutter optical system, etc. Additionally, a backlighting method may be employed in which exposure is performed from the back surface side of the image bearing member.

The developing step is a step of developing the latent electrostatic image with the use of any of the toners in after-mentioned Examples so as to form a visible image. The visible image can be formed using a developing unit. The developing unit may be suitably selected from known developing units and preferably includes a developing device which houses any of the toners in after-mentioned Examples and which is capable of attaching it to the latent electrostatic image in a contact or non-contact manner. The developing device may employ a dry developing method or a wet developing method. Also, the developing device may be a single-color developing device or a multicolor developing device. Specific examples thereof include a developing device including an agitator for charging a developer by means of agitation and friction, and a rotatable magnet roller.

Inside the developing device including a two-component developer, the toner and a carrier are mixed and agitated, and the toner is charged through friction generated by the mixing and agitation, and held in an upright position on the surface of the rotating magnet roller, thereby forming a magnetic brush. Since the magnet roller is placed in the vicinity of the image bearing member, part of the toner constituting the magnetic brush formed on the surface of the magnet roller is moved onto the surface of the image bearing member by electric suction. Consequently, the latent electrostatic image is developed with the toner, and a toner visible image is formed on the surface of the image bearing member.

The transfer step is a step of transferring the visible image onto a recording medium; it is desirable that an intermediate transfer member be used, and the visible image be primarily transferred onto the intermediate transfer member and then secondarily transferred onto the recording medium. Here, as the toner, toners of two or more colors are normally used, and full-color toners are preferably used. For this reason, it is further desirable that the transfer step consist of a primary transfer step for transferring visible images onto the intermediate transfer member so as to form a composite transfer image, and a secondary transfer step for transferring this composite transfer image onto the recording medium.

The transfer of each visible image from the image bearing member can be performed by charging the image bearing member, using a transfer unit. It is desirable that the transfer unit consist of a primary transfer unit for transferring visible images onto the intermediate transfer member so as to form a composite transfer image, and a secondary transfer unit for transferring this composite transfer image onto the recording medium. Note that the intermediate transfer member may be suitably selected from known transfer members in accordance with the intended use; for example, a transfer belt or the like may be used therefor.

The transfer unit preferably includes a transferrer which causes a visible image formed on the image bearing member to detach in a charged state toward the recording medium side. For the transfer unit, one or a plurality of transfer units may be provided. Specific examples of the transferrer include corona transferrers utilizing corona discharge, transfer belts, transfer rollers, pressure transfer rollers and adhesive transferrers. The recording medium may be suitably selected from known recording media; for example, transfer paper or the like may be used therefor.

The fixing step is a step of fixing visible images transferred onto the recording medium, with the use of a fixing unit. These visible images may be separately fixed upon transfer of the toners of each color onto the recording medium; alternatively, these visible images may be fixed at one time by previously combining together the toners of each color in a laminated form. The fixing unit may be suitably selected in accordance with the intended use; for example, a known heating and pressurizing unit may be used therefor. Examples of the heating and pressurizing unit include a combination of a heating roller and a pressurizing roller, and a combination of a heating roller, a pressurizing roller and an endless belt. In the heating and pressurizing unit, it is normally desirable that heating be conducted at a temperature of 80° C. to 200° C. Additionally, in accordance with the intended use, a known optical fixer may be used together with or instead of the fixing unit.

The charge eliminating step is a step of eliminating charge from the image bearing member by applying a charge eliminating bias thereto, which can be performed using a charge eliminating unit. The charge eliminating unit may be suitably selected from known charge eliminators; for example, a charge eliminating lamp or the like may be used therefor.

The cleaning step is a step of removing toner that remains on the image bearing member, which can be performed using a cleaning unit. The cleaning unit may be suitably selected from known cleaners; for example, a magnetic brush cleaner, an electrostatic brush cleaner, a magnetic roller cleaner, a blade cleaner, a brush cleaner, a web cleaner or the like may be used therefor, with preference being given to a blade cleaner.

The recycling step is a step of recycling the toner removed by the cleaning step, for use in the developing unit again, which can be performed using a recycling unit. The recycling unit may be suitably selected in accordance with the intended use; for example, a known conveying unit or the like may be used therefor.

The controlling step is a step of controlling the above-mentioned steps, which can be performed using a controlling unit. The controlling unit may be suitably selected in accordance with the intended use; for example, a device such as a sequencer or computer may be used therefor.

As just described, in the image forming apparatus, an image is fixed onto printing paper after undergoing a toner transporting step, the charging step, the exposing step, the developing step and the transfer step, wherein the toner transporting step transports toner from a toner cartridge to the developing unit, the charging step uniformly charges an image forming region on the image bearing member surface, the exposing step exposes the image bearing member to write a latent electrostatic image thereon, the developing step forms an image with the toner that has been charged through friction on the image bearing member, and the transfer step transfers the image, formed on the image bearing member, onto the printing paper directly or via the intermediate transfer member. Residual toner that has not been transferred and remains on the image bearing member is swept from the image bearing member by the cleaning step, and then a subsequent image forming process starts.

In the case where an electrophotographic image forming apparatus employs a two-component developing device, the mixture ratio between a toner and a carrier in the developing device is controlled to remain constant by detecting the toner concentration, etc. Accordingly, a toner housing container such as a toner bottle or a cartridge is provided inside or in the vicinity of a unit incorporating the developing device, and the toner is supplied from the toner housing container to the developing device according to the amount of toner consumed.

Typical examples of such a toner supply device that transports and supplies toner from a toner housing container to a developing device include a toner supply device that conveys toner using a mechanical conveyance member such as a screw or paddle; additionally, there is a toner supply device that conveys toner using a screw pump. A toner supply device using a screw pump makes it possible to increase the degree of freedom of its layout. Also, it is possible to place a conveyance tube between components in the vicinity of the toner supply device and thus to make an image forming apparatus compact. A toner supply device provided in the copier 100C of the present embodiment uses a uniaxial eccentric screw pump.

Figure 3:
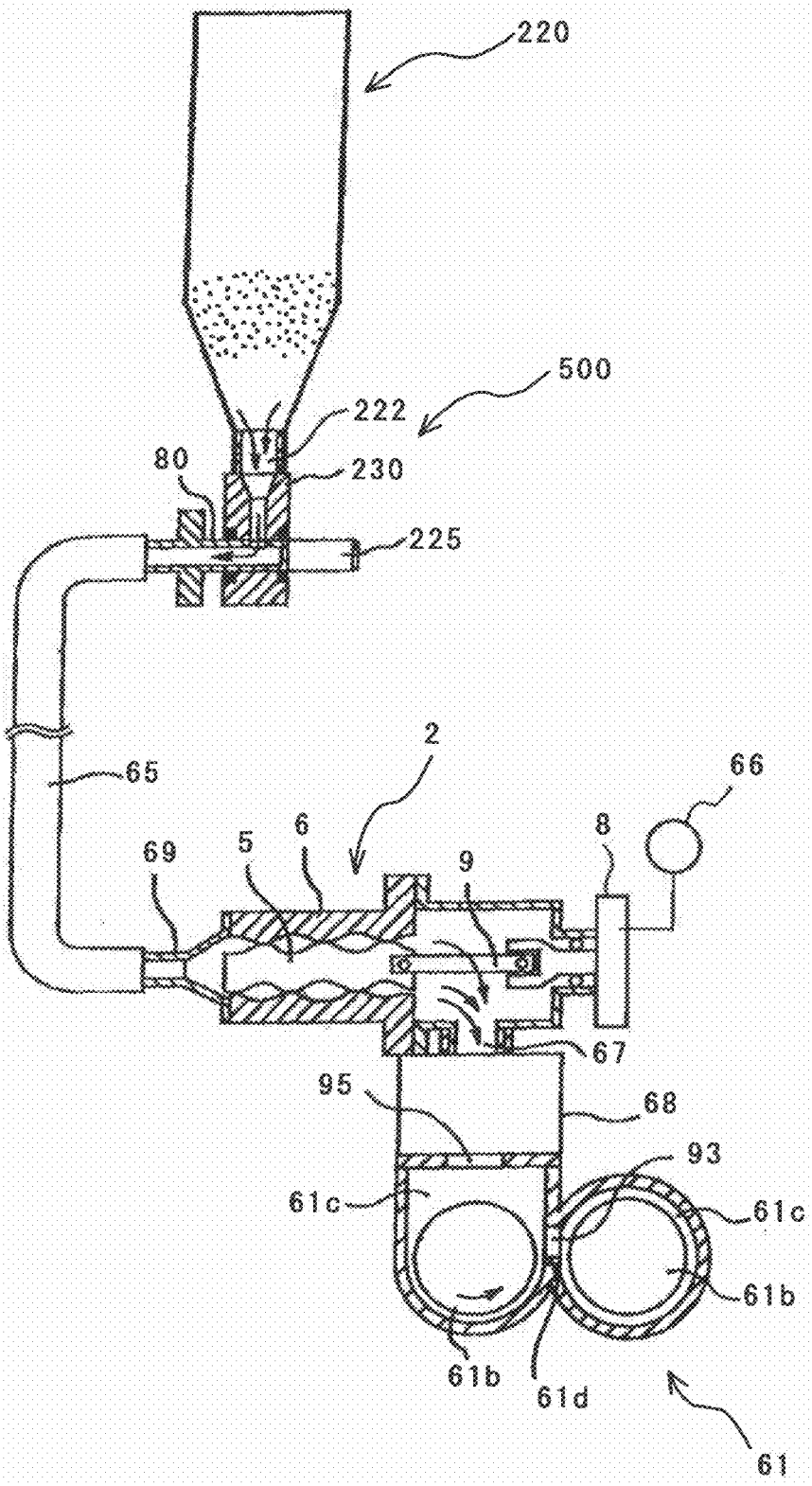
FIG. 3 is a schematic explanatory diagram of a toner supply device incorporated in the copier.
Figure 4:
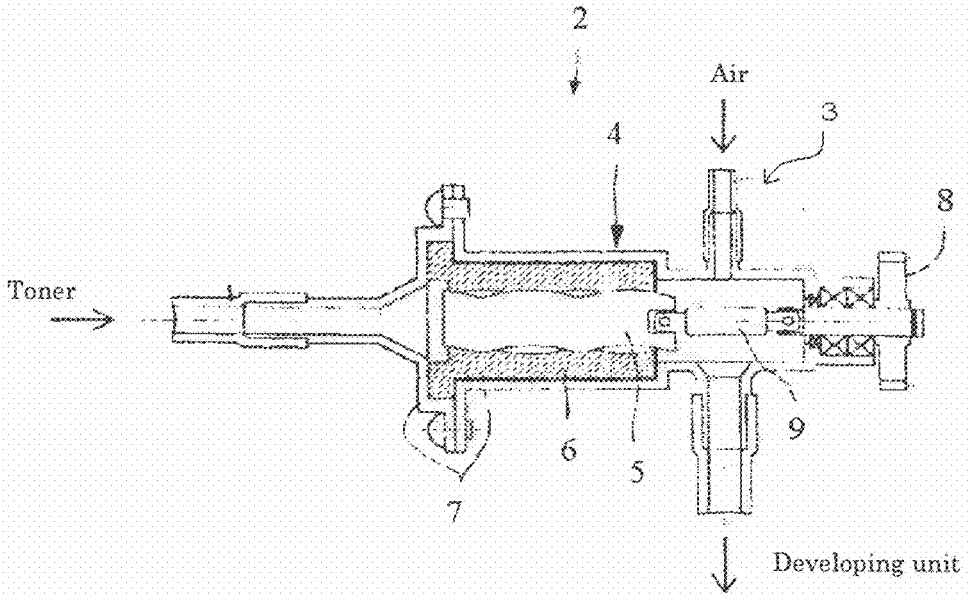
FIG. 4 is a cross-sectional explanatory diagram of a powder pump provided in the toner supply device.

FIG. 3 is an explanatory diagram schematically showing the structure of a toner supply device 500 (toner conveyance device) included in the copier 100C. FIG. 4 is a cross-sectional explanatory diagram of a powder pump 2 as a screw pump, provided in the toner supply device 500.

A toner bottle 220 (toner housing container) is a toner housing container which houses unused toner to be supplied into the developing device 61. In the copier 100C, which is a tandem-type image forming apparatus, toner bottles 220 that respectively house toners of different colors are arranged. The toner bottles 220 are each connected to a supply unit incorporating a sub-hopper 68, the powder pump 2 and some other components, via a toner supply tube 65 that is a toner conveyance path member, and the developing device 61 is connected to the bottom of the supply unit.

For the powder pump 2, a conventionally known uniaxial eccentric screw pump referred to as "Mohno pump" (described in Japanese Patent (JP-B) No. 3872506, for example) is used. As shown in FIG. 4, the powder pump 2 is formed in the shape of an eccentric screw by a stator 6 that is a cylindrical elastic member, made for example of rubber, having a 2-shaped spiral groove in its inner wall surface, and a rigid material such as metal, further including a rotor 5 that rotates inside the stator 6, and a holder 7 that encloses these components and forms a powder conveyance path. The stator 6 is installed in the holder 7 in a stationary manner. The rotor 5 is rotationally driven by means of a shaft joint 9 and a gear 8 joined to a motor 66 that is a drive source.

In the powder pump 2 having such a structure, rotation of the rotor 5 produces strong suction, which makes it possible to suck toner from a sucking portion 69 situated at an end of the holder 7 as shown by the arrow (concerning toner) in FIG. 4 and send out the sucked toner from a discharge portion 67 situated in the vicinity of the shaft joint 9 as shown by the arrow (concerning the developing unit) in FIG. 4. Also, air is supplied to the powder pump 2 from an air pump tube 3 as shown by the arrow (concerning air) in FIG. 4, thereby promoting fluidization of the toner that is sent out, and further ensuring transportation of the toner by the powder pump 2. Additionally, the driving of a motor specially made for the powder pump 2 or of a main motor in the copier 100C is transmitted to the gear 8 via and a clutch, and the powder pump 2 is thusly operated.

When each toner bottle 220 is set in the main body of the copier 100C, an end of a nozzle 80 serving as a joining member on the apparatus main body side, joined to a cap member 230, is inserted in the toner bottle 220. Thus, a toner outlet 222 and a toner receiving opening of the nozzle 80 become continuous. The nozzle 80 has a joint portion for connection to the tube, the toner supply tube 65 is continuous with the powder pump 2, and the powder pump 2 is continuous with the developing device 61 via the sub-hopper 68. Thus, when set in the main body of the copier 100C, each toner bottle 220 becomes continuous with the developing device 61 via the toner supply device 500.

As the rotor 5 is rotationally driven, suction is produced in the sucking portion 69, which causes the toner in the toner bottle 220 to be sucked; then the toner having passed through the powder pump 2 is sent from the discharge portion 67 to the sub-hopper 68. The toner in the sub-hopper 68 is supplied into a developer housing section 61*c* through a toner supply opening 95, both of which are provided in the developing device 61.

The toner supplied into the developer housing section 61*c* and a developer are agitated together, while being conveyed by two developer conveying screws 61*b* provided in the developer housing section 61*c*, with the direction of the toner and the developer conveyed by one of them being opposed to the direction of the toner and the developer conveyed by the other of them with respect to the axial direction. The two developer conveying screws 61*b* are divided by a partition wall 61*d*, and the partition wall 61*d* is provided with opening portions 93 at both its ends with respect to the axial direction of the screw. Conveyed in opposite directions by the two developer conveying screws 61*b*, the developer passes through the opening portions 93 and circulates inside the developer housing section 61*c* partitioned by the partition wall 61*d*.

The toner in the developer housing section 61*c* of the developing device 61 is borne by a developing roller 61*a* along with the carrier, and the toner and the carrier are used for developing a latent electrostatic image on the photoconductor 10 and thusly consumed. The toner supply device 500 supplies the toner according to the amount of toner consumed as a result of being used by the developing device 61.

As just described, the toner supply device 500 supplies the toner to the developing device 61 and includes the toner bottle 220 which houses the toner, the unit configured to convey the toner from the toner bottle 220, and the unit configured to transfer the toner to the developing device 61. The powder pump 2 provided in the toner supply device 500 serves as a sucking unit for conveying the toner from the toner bottle 220 and also serves as a sucking unit for transferring the toner, which has been conveyed from the toner bottle 220, to the developing device 61.

Since the powder pump 2 has a simple structure and is compact, there is less mechanical stress on toner transported in the toner supply tube 65 serving as a conveyance path than in the case where toner is conveyed in a conveyance path with the use of an auger such as a screw or a coil.

However, the screw pump used for the powder pump 2 is basically configured to transport the toner as a toner-air mixture, and the toner is transported with a contact portion of the rotor 5 and a contact portion of the stator 6 rubbing against each other. For this reason, the toner is given stress attributable to frictional heat, shearing force, pressure, etc. in gaps between the rotor 5 and the stator 6, which exist at the contact portions, and thus toner aggregates of 0.1 mm to 1 mm in diameter are produced in some cases.

The cohesion of these aggregates is weak to such an extent that they crumble when touched by fingertips; thus, some of the aggregates are broken into fine pieces through agitation by the developer conveying screws 61*b* serving as an agitating member inside the developer housing section 61*c* and come back into the state of ordinary toner powder even if supplied to the developing device 61 along with other toner.

In some cases, however, some others of the aggregates with higher cohesiveness are not broken into fine pieces inside the developer housing section 61*c* and thusly supplied to the developing roller 61*a* that supplies toner to a latent image on the surface of the photoconductor 10. Once the aggregates have been supplied onto the surface of the photoconductor 10, they can no longer be broken into fine pieces. When these aggregates are transferred from the photoconductor 10 to transfer paper by an intermediate transfer unit that has the intermediate transfer belt 50 and serves as a transfer device, image defect is caused. For instance, in the case of a solid image (in which a single color is used and the amount of toner attached is 0.45 mg/cm$^2$), an abnormal image called "firefly" is produced in which a spot whose color is deep in comparison with the solid image ID is formed at the part where the aggregates have been attached, and a pale color area is formed in the vicinity of the deep color spot. Meanwhile, in the case of a linear image, the part where the aggregates have been attached blackens, and thus thin lines may be unable to be reproduced.

As to the powder pump 2 used in the copier 100C, the rotary torque of the rotor 5 is 0.25 N·m to 1.0 N·m, the temperature in the powder pump 2 when the rotor 5 is rotated is 45° C. to 60° C., and a heat of approximately 45° C. to 50° C. is applied to the toner.

As the amount of small particle size silica having a BET specific surface area of 50 m$^2$/g to 400 m$^2$/g, added as an external additive to the toner, becomes larger, the fluidity of the toner increases, which makes it possible to prevent production of aggregates. However, excessive addition of the small particle size silica causes cleaning defect and a rise in the bulk density of the toner.

Here, the method for measuring the BET specific surface area is explained.

The BET specific surface area of the small particle size silica added to the toner used in the present embodiment was calculated by measuring the specific surface area in accordance with the nitrogen adsorption method.

As for specific measurement conditions, the automatic specific surface area and pore distribution measuring device TRISTAR3000 (manufactured by Shimadzu Corporation) is used, and the BET multipoint method (the relationship between the relative pressure and the amount of nitrogen adsorbed is determined, and the surface area per gram is calculated based upon the BET theory) is employed. In the measurement, in order to remove impurities, particularly moisture, on the sample surface, a process of removing impurities by carrying out vacuum deaeration for 24 hr as a pretreatment is required.

<Measurement of Specific Surface Area in Accordance with Nitrogen Adsorption Method>

The specific surface area was calculated in accordance with the BET method, with the amount of nitrogen adsorbed at liquid nitrogen temperature being measured under an absolute equilibrium adsorption pressure of 0.35 MPa or less. The specific surface area and pore diameter distribution of a measurement sample, which had been dried at 120° C. for 24 hr and weighed, then subjected to a decompression treatment at 200° C. for 2 hr, were calculated from an adsorption isotherm, using a high-speed specific surface area and pore distribution measuring device (ASAP2010, manufactured by Micromeritics Instrument Corporation).

<Measurement of Average Particle Diameter>

The average diameter of silica particles of 1 mm or less in diameter was measured using a laser diffraction scattering method particle size distribution measuring device (LS-230, manufactured by Coulter Corporation). A dispersion liquid for the measurement was prepared similarly to the preparation described in "Particle Measuring Technique" (The Society of Powder Technology, Japan, 1994, published by Nikkan Kogyo Shimbun Ltd., p. 23). The particle diameter which stood at 50% in a mass cumulative distribution was defined as the average particle diameter.

As to prevention of the troubles caused when using such a screw pump as described above, use of any of the toners in after-mentioned Examples in the copier 100C of the present embodiment makes it possible to prevent the occurrence of image defect that stems from formation of toner aggregates inside the powder pump 2 and also to prevent the occurrence of trouble that stems from excessive addition of the small particle size silica.

The toner used in the copier 100C, produced by aqueous granulation, is preferably a toner obtained by dissolving and/or dispersing in an organic solvent at least a binder resin, a prepolymer derived from a modified polyester resin, a compound capable of elongating and/or cross-linking with the prepolymer, a colorant, a releasing agent, and a modified layered inorganic mineral in which at least part of interlayer ions are modified with organic ions (hereinafter simply referred to as "modified layered inorganic mineral") so as to prepare a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction.

Also, the following toner can be more suitably used in the copier 100C: a toner obtained by elongating and/or cross-linking in an aqueous solvent a toner material solution in which at least a polyester prepolymer that has a nitrogen atom-containing functional group, a polyester, a compound capable of elongating and/or cross-linking with the prepolymer, a colorant, a releasing agent and a modified layered inorganic mineral are dispersed in an organic solvent.

The following explains materials of which the toner is composed, and a method for producing the toner.

<Binder Resin>

The binder resin is not particularly limited and may be suitably selected in accordance with the intended use, with preference being given to the polyesters described below.

<<Polyester>>

A polyester is obtained by subjecting a polyhydric alcohol compound and a polyvalent carboxylic acid compound to a polycondensation reaction.

Examples of the polyhydric alcohol compound (PO) include dihydric alcohols (DIO) and trihydric or higher alcohols (TO), with preference being given to dihydric alcohols (DIO) or mixtures which are each composed of a dihydric alcohol (DIO) and a small amount of a trihydric or higher alcohol (TO). Examples of the dihydric alcohols (DIO) include alkylene glycols (ethylene glycol, 1,2-propylene glycol, 1,3-propylene glycol, 1,4-butanediol, 1,6-hexanediol, etc.); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols.

Among these, preference is given to alkylene glycols having 2 to 12 carbon atoms, and alkylene oxide adducts of bisphenols, and particular preference is given to alkylene oxide adducts of bisphenols, and combinations which are each composed of an alkylene oxide adduct of a bisphenol and an alkylene glycol having 2 to 12 carbon atoms. Examples of the trihydric or higher alcohols (TO) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polyvalent carboxylic acid compound (PC) include divalent carboxylic acids (DIC) and trivalent or higher carboxylic acids (TC), with preference being given to divalent carboxylic acids (DIC) or mixtures which are each composed of a divalent carboxylic acid (DIC) and a small amount of a trivalent or higher carboxylic acid (TC). Examples of the divalent carboxylic acids (DIC) include alkylene dicarboxylic acids (succinic acid, adipic acid, sebaciacicid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Among these, preference is given to alkenylene dicarboxylic acids having 4 to 20 carbon atoms and aromatic dicarboxylic acids having 8 to 20 carbon atoms. Examples of the trivalent or higher carboxylic acids (TC) include aromatic polyvalent carboxylic acids (trimellitic acid, pyromellitic acid, etc.) having 9 to 20 carbon atoms. Besides any of these compounds, an acid anhydride or a lower alkyl ester (methyl ester, ethyl ester, isopropyl ester, etc.) may be used as the polyvalent carboxylic acid (PC) and subjected to a reaction with the polyhydric alcohol (PO).

As for the ratio of the polyhydric alcohol (PO) to the polyvalent carboxylic acid (PC), the equivalence ratio [OH]/[COOH] of the hydroxyl group [OH] to the carboxyl group [COOH] is normally in the range of 2/1 to 1/1, preferably in the range of 1.5/1 to 1/1, more preferably in the range of 1.3/1 to 1.02/1.

In the polycondensation reaction between the polyhydric alcohol (PO) and the polyvalent carboxylic acid (PC), they are heated to 150° C. to 280° C. in the presence of a known esterified catalyst such as tetrabutoxy titanate or dibutyltin oxide, and water produced is distilled away, with a reduction in pressure if necessary, so as to obtain a hydroxyl group-containing polyester. The polyester preferably has a hydroxyl value of 5 or greater and normally has an acid value of 1 to 30, preferably 5 to 20. The fact that the polyester has an acid value makes it easier for the polyester to be negatively charged, and further, enables the toner to have a favorable affinity with transfer paper when fixed thereon, thereby improving the low-temperature toner-fixing property. However, when the acid value is greater than 30, the charging stability tends to degrade, especially in relation to an environmental change.

The weight average molecular weight of the polyester is 10,000 to 400,000, preferably 20,000 to 200,000. When the weight average molecular weight is less than 10,000, it is not favorable because the resistance to offset degrades. When the weight average molecular weight is greater than 400,000, it is not favorable either because the low-temperature toner-fixing property degrades.

<Prepolymer Made of Modified Polyester Resin>

The prepolymer derived from a modified polyester resin is preferably a polyester prepolymer having a nitrogen atom-containing functional group. The polyester prepolymer having a nitrogen atom-containing functional group is preferably an isocyanate group-containing polyester prepolymer (A) produced by effecting a reaction between a polyvalent isocyanate compound (PIC) and a carboxyl group, a hydroxyl group, etc. present at a terminal of the polyester obtained in the polycondensation reaction. In this case, examples of the compound capable of elongating and/or cross-linking with the prepolymer include amines. Due to a reaction between the isocyanate group-containing polyester prepolymer (A) and an amine, a molecular chain is elongated and/or cross-linked, and thus a urea-modified polyester is obtained.

Examples of the polyvalent isocyanate compound (PIC) include aliphatic polyvalent isocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates ($\alpha,\alpha,\alpha',\alpha'$-tetramethylxylylene diisocyanate, etc.); isocyanates; compounds which are each produced by blocking any of the polyisocyanates with a phenol derivative, an oxime, caprolactam, etc.; and combinations which are each composed of any two or more of these.

As for the ratio of the polyvalent isocyanate compound (PIC) to the polyester, the equivalence ratio [NCO]/[OH] of the isocyanate group [NCO] to the hydroxyl group [OH] of the hydroxyl group-containing polyester is normally in the range of 5/1 to 1/1, preferably in the range of 4/1 to 1.2/1, more preferably in the range of 2.5/1 to 1.5/1. When the equivalence ratio [NCO]/[OH] is greater than 5, the low-temperature toner-fixing property degrades. When the isocyanate group [NCO] is less than 1 in the molar ratio, the resistance to hot offset degrades in the case where a urea-modified polyester is used, because the amount of the urea contained in the ester is small.

The amount of the component/components of the polyvalent isocyanate compound (PIC) in the isocyanate group-containing polyester prepolymer (A) is normally 0.5% by mass to 40% by mass, preferably 1% by mass to 30% by mass, more preferably 2% by mass to 20% by mass. When the amount is less than 0.5% by mass, the resistance to hot offset degrades, and there is difficulty in achieving a favorable balance between heat-resistant storage property and low-temperature toner-fixing property. When the amount is greater than 40% by mass, the low-temperature toner-fixing property degrades.

The number of isocyanate groups contained per molecule in the isocyanate group-containing polyester prepolymer (A) is normally 1 or more, preferably 1.5 to 3 on average, more preferably 1.8 to 2.5 on average. When the number thereof per molecule is less than 1, the resistance to hot offset degrades because the molecular weight of the urea-modified polyester is low.

Next, examples of the amine (B) to react with the polyester prepolymer (A) include divalent amine compounds (B1), trivalent or higher amine compounds (B2), amino alcohols (B3), amino mercaptans (B4), amino acids (B5), and compounds (B6) which are each produced by blocking an amino group of any of (B1) to (B5).

Examples of the divalent amine compounds (B1) include aromatic diamines (phenylenediamine, diethyltoluenediamine, 4,4'-diaminodiphenylmethane, etc.); alicyclic diamines (4,4'-diamino-3,3'-dimethyldicyclohexylmethane, diaminecyclohexane, isophoronediamine, etc.); and aliphatic diamines (ethylenediamine, tetramethylenediamine, hexamethylenediamine, etc.). Examples of the trivalent or higher amine compounds (B2) include diethylenetriamine and triethylenetetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), which are each produced by blocking an amino group of any of (B1) to (B5), include oxazolidine compounds and ketimine compounds each derived from any of the amines of (B1) to (B5) and a ketone (acetone, methy ethyl ketone, methyl isobutyl ketone, etc.). Among these amines (B), preference is given to B1 and mixtures which are each composed of any of B1 and a small amount of any of B2.

As for the ratio of the isocyanate group-containing polyester prepolymer (A) to the amine (B), the equivalence ratio [NCO]/[NHx] of the isocyanate group [NCO] in the isocyanate group-containing polyester prepolymer (A) to the amino group [NHx] in the amine (B) is normally in the range of 1/2 to 2/1, preferably in the range of 1.5/1 to 1/1.5, more preferably in the range of 1.2/1 to 1/1.2. When the equivalence ratio [NCO]/[NHx] is greater than 2 or less than ½, the resistance to hot offset degrades because the molecular weight of the urea-modified polyester is low.

The urea-modified polyester may contain a urethane bond as well as a urea bond. The molar ratio of the amount of the urea bond to the amount of the urethane bond is normally in the range of 100/0 to 10/90, preferably in the range of 80/20 to 20/80, more preferably in the range of 60/40 to 30/70. When the urea bond is less than 10% in the molar ratio, the resistance to hot offset degrades.

The urea-modified polyester is produced by a one-shot method or the like. The polyhydric alcohol (PO) and the polyvalent carboxylic acid (PC) are heated to 150° C. to 280° C. in the presence of a known esterified catalyst such as tetrabutoxy titanate or dibutyltin oxide, and water produced is distilled away, with a reduction in pressure if necessary, so as to obtain a hydroxyl group-containing polyester. Subsequently, the hydroxyl group-containing polyester is made to react with the polyvalent isocyanate compound (PIC) at 40° C. to 140° C. so as to obtain the isocyanate group-containing polyester prepolymer (A). Further, the polyester prepolymer (A) is made to react with the amine (B) at 0° C. to 140° C. so as to obtain a urea-modified polyester.

When the polyvalent isocyanate compound (PIC) is subjected to the reaction and when the polyester prepolymer (A) and the amine (B) are made to react with each other, a solvent may be used in accordance with the necessity. Examples of solvents able to be used include those which are inactive to isocyanates (PIC), such as aromatic solvents (toluene, xylene, etc.), ketones (acetone, methyl ethyl ketone, methyl isobutyl ketone, etc.), esters (ethyl acetate); amides (dimethylformamide, dimethylacetamide, etc.), and ethers (tetrahydrofuran, etc.).

Also, for the elongation reaction and/or the cross-linking reaction between the polyester prepolymer (A) and the amine (B), a reaction terminator may if necessary be used so as to adjust the molecular weight of the urea-modified polyester obtained. Examples of the reaction terminator include monoamines (diethylamine, dibutylamine, butylamine, laurylamine, etc.); and compounds (ketimine compounds) which are each produced by blocking any of those monoamines.

The weight average molecular weight of the urea-modified polyester is normally 10,000 or greater, preferably 20,000 to 10,000,000, more preferably 30,000 to 1,000,000. When it is less than 10,000, the resistance to hot offset degrades. The number average molecular weight of the urea-modified polyester, etc. is not particularly limited when the after-mentioned unmodified polyester is used, and the number average molecular weight may be freely selected as long as the above-mentioned weight average molecular weight can be easily attained. When the urea-modified polyester is solely used, its number average molecular weight is normally 2,000 to 15,000, preferably 2,000 to 10,000, more preferably 2,000 to 8,000. When it is greater than 20,000, the low-temperature toner-fixing property degrades, and the glossiness degrades in the case of use in a full-color apparatus.

Since the use of the urea-modified polyester together with an unmodified polyester makes it possible to improve the low-temperature toner-fixing property and also to improve the glossiness in the case of use in a full-color image forming apparatus exemplified by the copier 100C, it is more desirable to use the urea-modified polyester and an unmodified polyester together than to use the urea-modified polyester solely. Additionally, the unmodified polyester may contain a polyester which has been modified with a chemical bond other than a urea bond.

It is desirable in terms of low-temperature toner-fixing property and resistance to hot offset that the urea-modified polyester and the unmodified polyester be compatible with each other at least partially. Accordingly, the urea-modified polyester and the unmodified polyester preferably have similar compositions.

Examples of the unmodified polyester include polycondensates that are each composed of the polyhydric alcohol (PO) and the polyvalent carboxylic acid (PC), which are similar to the above-mentioned components of the urea-modified polyester, and suitable examples thereof are also similar to those suitable for the urea-modified polyester. The weight average molecular weight (Mw) of the unmodified polyester is 10,000 to 300,000, preferably 14,000 to 200,000. The number average molecular weight (Mn) of the unmodified polyester is 1,000 to 10,000, preferably 1,500 to 6,000.

The mass ratio of the unmodified polyester to the urea-modified polyester is normally in the range of 20/80 to 95/5, preferably in the range of 70/30 to 95/5, more preferably in the range of 75/25 to 95/5, most preferably in the range of 80/20 to 93/7. When the urea-modified polyester is less than 5% in the mass ratio, the resistance to hot offset degrades, and there is difficulty in achieving a favorable balance between heat-resistant storage property and low-temperature toner-fixing property.

The glass transition temperature (Tg) of the binder resin containing the urea-modified polyester and the unmodified polyester is normally 45° C. to 65° C., preferably 45° C. to 60° C. When it is lower than 45° C., the heat resistance of the toner degrades. When it is higher than 65° C., the low-temperature toner-fixing property is insufficient.

The urea-modified polyester tends to be present on the surface of toner base particles obtained; hence, the toner in the present embodiment tends to be superior to a known polyester-based toner in heat-resistant storage property even when the glass transition temperature is low.

<Colorant>

The colorant may be selected from all known dyes and pigments.

Examples of those for black toner include carbon black, nigrosine dyes and iron black.

Examples of those for yellow toner include Naphthol Yellow S, Hansa Yellow (10G, 5G, G), cadmium yellow, yellow iron oxide, ocher, chrome yellow, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazane Yellow BGL and isoindolinone yellow.

Examples of those for magenta toner include red ochre, red lead, vermilion lead, cadmium red, cadmium mercury red, antimony vermilion, Permanent Red 4R, Para Red, Fire Red, p-chlor-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, Bon Maroon Light, Bon Maroon Medium, Eosin Lake, Rhodamine Lake B, Rhodamine Lake Y. Alizarine Lake, Thioindigo Red B, Thioindigo Maroon, oil red, quinacridone red, pyrazolone red, polyazo red, chrome vermilion, benzidine orange, perynone orange and oil orange.

Examples of those for cyan toner include cobalt blue, cerulean blue, Alkali Blue Lake, Peacock Blue Lake, Victoria Blue Lake, metal-free phthalocyanine blue, phthalocyanine blue, Fast Sky Blue, Indanthrene Blue (RS, BC), indigo, ultramarine, Prussian blue, anthraquinone blue, Fast Violet B, Methyl Violet Lake, cobalt violet, manganese violet, dioxane violet, anthraquinone violet, chrome green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide and lithopone.

Also, the colorant is not limited to the above-mentioned examples and may be selected from mixtures of the above-mentioned examples.

The amount of the colorant contained is normally 1% by mass to 15% by mass, preferably 3% by mass to 10% by mass, with respect to the amount of toner base particles.

Compounded with a resin, the colorant may be used as a master batch. Examples of a binder resin used in producing a master batch or kneaded with a master batch include styrene monomers and polymers of substituted products thereof, such as polystyrene, poly-p-chlorostyrene and polyvinyl toluene, copolymers of these and vinyl compounds, polymethyl methacrylate, polybutyl methacrylate, polyvinyl chloride, polyvinyl acetate, polyethylene, polypropylene, polyesters, epoxy resins, epoxy polyol resins, polyurethane, polyamides, polyvinyl butyral, polyacrylic acid resins, rosins, modified rosins, terpene resins, aliphatic or alicyclic hydrocarbon resins, aromatic petroleum resins, chlorinated paraffins and paraffin waxes. Each of these may be used alone or in combination with two or more.

<Charge Controlling Agent>

A charge controlling agent may be selected from known charge controlling agents and examples thereof include negrosine dyes, triphenylmethane dyes, chromium-containing metal complex dyes, molybdic acid chelate dyes, rhodamine dyes, alkoxy amines, quaternary ammonium salts (including fluorinated quaternary ammonium salts), alkyl amides, phosphorus and compounds thereof, tungsten and compounds thereof, fluorine-based activating agents, metal salts of salicylic acid and metal salts of salicylic acid derivatives.

Specific examples thereof include Bontron 03 as a negrosine dye, Bontron P-51 as a quaternary ammonium salt, Bontron S-34 as a metal-containing azo dye, E-82 as an oxynaphthoic acid metal complex, E-84 as a salicylic acid metal complex, and E-89 as a phenolic condensate (all of which are produced by Orient Chemical Industries); TP-302 and TP-415 as quaternary ammonium salt molybdenum complexes (both of which are produced by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (all of which are produced by Hoechst); LRA-901, and LR-147 as a boron complex (both of which are produced by Japan Carlit Co., Ltd.); copper phthalocyanine, perylene, quinacridone, azo pigments; and polymeric compounds containing functional groups such as sulfonic acid group, carboxyl group and quaternary ammonium salt. Among these, preference is given to substances which control the toner to have negative polarity.

The amount of the charge controlling agent used is not unequivocally limited but determined by the type of the binder resin, the presence or absence of an additive or additives used in accordance with the necessity, and the toner producing method including a dispersing method. The amount of the charge controlling agent is preferably in the range of 0.1 parts by mass to 10 parts by mass, more preferably in the range of 0.2 parts by mass to 5 parts by mass, per 100 parts by mass of the binder resin. When the amount is greater than 10 parts by mass, the chargeability of the toner is so great that the effects of the charge controlling agent are reduced, and the electrostatic suction between the toner with a developer and a developing roller increases, leading to a reduction in the fluidity of the developer and a decrease in image density.

<Releasing Agent>

As to the releasing agent, a wax having a low melting point of 50° C. to 120° C. effectively acts as a releasing agent between a fixing member (equivalent to the fixing belt 26 in the copier 100C) and the toner interface when dispersed with the binder resin; thus, the resistance to hot offset can be effectively enhanced without needing to apply an oil-like releasing agent to the fixing member. Examples of such a wax component are as follows: vegetable waxes such as carnauba wax, cotton wax, tree wax and rice wax; animal waxes such as beeswax and lanolin; mineral waxes such as ozokerite and ceresin; and petroleum waxes such as paraffin, microcrystalline and petrolatum. Besides these natural waxes, examples thereof include synthetic hydrocarbon waxes such as Fischer-Tropsch wax and polyethylene wax; and synthetic waxes such as esters, ketones and ethers. Example thereof further include fatty acid amides such as 12-hydroxystearic acid amide, stearic acid amide, anhydrous phthalic acid imide and chlorinated hydrocarbon; and crystalline polymers each having a long alkyl group in a side chain, exemplified by homopolymers or copolymers of polyacrylates such as poly-n-stearyl methacrylate and poly-n-lauryl methacrylate, which are low-molecular weight crystalline polymer resins (e.g. n-stearyl acrylate-ethyl methacrylate copolymer).

The charge controlling agent and the releasing agent may be melted and kneaded with the master batch and the binder resin and may of course be added when those components are dissolved or dispersed in the organic solvent.

<Modified Layered Inorganic Mineral>

The modified layered inorganic mineral contained in the toner used in the copier 100C has to be capable of keeping the Casson yield value in the range of 1 Pa to 100 Pa at 25° C. in the solution or the dispersion liquid produced by dissolving and/or dispersing in the organic solvent at least the binder resin, the prepolymer derived from a modified polyester resin, the compound capable of elongating and/or cross-linking with the prepolymer, the colorant, the releasing agent and the modified layered inorganic mineral.

When the Casson yield value is less than 1 Pa, a desired form is hard to obtain. When the Casson yield value is greater than 100 Pa, the production capability degrades.

The Casson yield value is calculated by measuring the viscosity of the oil phase only, when the solution or the dispersion liquid is emulsified in the aqueous medium.

The modified layered inorganic mineral preferably occupies 0.05% by mass to 10% by mass of the solid content of the solution or the dispersion liquid. When the amount of the modified layered inorganic mineral is less than 0.05% by mass, the desired Casson yield value cannot be obtained. When the amount of the modified layered inorganic mineral is greater than 10% by mass, the toner-fixing property degrades.

The modified layered inorganic mineral is a layered inorganic mineral in which at least part of interlayer ions are modified with organic ions. Examples thereof include a layered inorganic mineral in which at least part of interlayer metal cations are modified with quaternary ammonium ions, and specific examples thereof include organically modified montmorillonites and organically modified smectites.

<Method for Measuring Casson Yield Value>

The Casson yield value can be measured using a high-shear viscometer or the like. The measurement conditions are as follows.

Device: AR2000 (manufactured by TA Instruments)

Shear stress: 120 [Pa/5 min]

Geometry: 40 mm steel plate

Geometry gap: 1 mm

Analysis software: TA DATA ANALYSIS (manufactured by TA Instruments)

<Production Method>

Next, a method for producing the toner will be explained. In the explanation, a desirable production method is described; it should be noted that the present invention is not confined thereto.

(i) A toner material solution is produced by dispersing in an organic solvent a binder resin (unmodified polyester), an isocyanate group-containing polyester prepolymer, a compound (amine) capable of elongating and/or cross-linking with the prepolymer, a colorant, a releasing agent, and a modified layered inorganic mineral in which at least part of interlayer ions are modified with organic ions.

It is desirable that the organic solvent have a boiling point of less than 100° C. and be volatile because the organic solvent can be easily removed after toner base particles have been formed. Specific examples thereof include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone, each of which may be used alone or in combination with two or more. Particularly suitable examples thereof include aromatic solvents such as toluene and xylene; and halogenated hydrocarbons such as methylene chloride, 1,2-dichloroethane, chloroform and carbon tetrachloride. The amount of the organic solvent used is normally 0 parts by mass to 300 parts by mass, preferably 0 parts by mass to 100 parts by mass, more preferably 25 parts by mass to 70 parts by mass, per 100 parts by mass of the polyester prepolymer.

(ii) The toner material solution is emulsified in an aqueous medium in the presence of a surfactant and fine resin particles. The aqueous medium may be composed only of water or contain an organic solvent such as an alcohol (methanol, isopropyl alcohol, ethylene glycol, etc.), dimethylformamide, tetrahydrofuran, a cellusolve (methyl cellusolve, etc.) or a lower ketone (acetone, methyl ethyl ketone, etc.).

The amount of the aqueous medium used is normally 50 parts by mass to 2,000 parts by mass, preferably 100 parts by mass to 1,000 parts by mass, per 100 parts by mass of the toner material solution. When the amount is less than 50 parts by mass, the toner material solution is in a poor dispersion state, and thus toner particles having a predetermined diameter cannot be obtained. When the amount is greater than 20,000 parts by mass, it is not desirable from an economical point of view.

Also, to improve the dispersion in the aqueous medium, dispersants such as a surfactant and fine resin particles are added accordingly.

Examples of the surfactant include anionic surfactants such as alkylbenzene sulfonates, α-olefin sulfonates and phosphoric acid esters; amine salt-based surfactants such as alkylamine salts, aminoalcohol fatty acid derivatives, polyamine fatty acid derivatives and imidazoline; quaternary ammonium salt-based cationic surfactants such as alkyltrimethyl ammonium salts, dialkyl dimethyl ammonium salts, alkyl dimethyl benzyl ammonium salts, pyridinium salts, alkyl isoquinolinium salts and benzetonium chloride; nonionic surfactants such as fatty acid amide derivatives and polyhydric alcohol derivatives; and amphoteric surfactants such as alanine, dodecyldi(aminoethyl) glycine, di(octylaminoethyl)glycine and N-alkyl-N, N-dimethylammoniumbetaine.

Use of a fluoroalkyl group-containing surfactant makes it possible to produce its effects even when used in very small amounts. Suitable examples of fluoroalkyl group-containing anionic surfactants include fluoroalkyl carboxylic acids each having 2 to 10 carbon atoms, and metal salts thereof, disodium perfluorooctanesulfonylglutamate, sodium 3-[ω-fluoroalkyl(C6 to C11)oxy]-1-alkyl(C3 to C4)sulfonate, sodium 3-[ω-fluoroalkanoyl(C6 to C8)-N-ethylamino]-1-propanesulfonate, fluoroalkyl(C11 to C20) carboxylic acids and metal salts thereof, perfluoroalkylcarboxylic acids (C7 to C13) and metal salts thereof, perfluoroalkyl(C4 to C12)sulfonic acids and metal salts thereof, perfluorooctanesulfonic acid diethanolamide, N-propyl-N-(2-hydroxyethyl)perfluorooctane sulfonamide, perfluoroalkyl(C6 to C10)sulfonamide propyltrimethylammonium salts, perfluoroalkyl(C6 to C10)-N-ethylsulfonylglycine salts and monoperfluoroalkyl (C6 to C16)ethyl phosphoric acid esters.

Examples of fluoroalkyl group-containing anionic surfactants as products include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFAC F-110, F-120, F-113, F-191, F-812 and F-833 (produced by Dainippon Ink And Chemicals, Incorporated); ECTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of cationic surfactants include fluoroalkyl group-containing aliphatic primary, secondary or tertiary amines, aliphatic quaternary ammonium salts such as perfluoroalkyl(C6 to C10)sulfonamide propyltrimethylammonium salts, benzalkonium salts, benzetonium chloride, pyridinium salts and imidazolinium salts. Examples of cationic surfactants as products include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFAC F-150 and F-824 (produced by Dainippon Ink And Chemicals, Incorporated), ECTOP EF-132 (produced by produced by Tochem Products Co., Ltd.), and FTERGENT F-300 (produced by NEOS COMPANY LIMITED).

The fine resin particles are added to stabilize the toner base particles formed in the aqueous medium. Accordingly, the fine resin particles are preferably added so as to cover 10% to 90% of the surface of the toner base particles. Examples of the fine resin particles include polymethyl methacrylate fine particles (1 μm and 3 μm), polystyrene fine particles (0.5 μm and 2 μm) and poly(styrene-acrylonitrile) fine particles (1 μm). Examples of the fine resin particles as products include PB-200H (produced by Kao Corporation), SGP (produced by Soken Chemical & Engineering Co., Ltd.), TECHNOPOLYMER SB (produced by SEKISUI PLASTICS CO., LTD.), SGP-3G (produced by Soken Chemical & Engineering Co., Ltd.), and MICROPEARL (produced by Fine Chemical Division in SEKISUI CHEMICAL CO., LTD.).

Also, inorganic compound dispersants such as tricalcium phosphate, calcium carbonate, titanium oxide, colloidal silica and hydroxyappetite may be used as well.

As a dispersant able to be used in combination with the fine resin particles and the inorganic compound dispersant, a polymeric protective colloid may be added to stabilize dispersion droplets. Examples thereof include acids such as acrylic acid, methacrylic acid, α-cyanoacrylic acid, α-cyanomethacrylic acid, itaconic acid, crotonic acid, fumaric acid, maleic acid and maleic anhydride; hydroxyl group-containing (meth)acrylic monomers such as acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid-3-chloro-2-hydroxypropyl, methacrylic acid-3-chloro-2-hydroxypropyl, diethyleneglycolmonoacrylic acid esters, diethyleneglycolmonomethacrylic acid esters, glycerinmonoacrylic acid esters, glycerinmonomethacrylic acid esters, N-methylolacrylamide and N-methylolmethacrylamide; vinyl alcohol and ethers of vinyl alcohol such as vinyl methyl ether, vinyl ethyl ether and vinyl propyl ether; esters of carboxyl group-containing compounds and vinyl alcohol, such as vinyl acetate, vinyl propionate and vinyl butyrate; acrylamide, methacrylamide, diacetone acrylamide, and methylol compounds thereof; acid chlorides such as acrylic acid chloride and methacrylic acid chloride; homopolymers and copolymers of nitrogen-containing compounds such as vinyl pyridine, vinyl pyrolidone, vinyl imidazole and ethyleneimine, and of these nitrogen-containing compounds each having a heterocyclic ring; polyoxyethylene-based compounds such as polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester; and celluloses such as methyl cellulose, hydroxyethyl cellulose and hydroxypropyl cellulose.

The dispersing method is not particularly limited, and known equipment can be used for the dispersion, for example a low-speed shearing dispersing device, a high-speed shearing dispersing device, a friction-type dispersing device, a high-pressure jet dispersing device or an ultrasonic wave dispersing device. Among these, a high-speed shearing dispersing device is preferable in adjusting the particle diameter of a dispersion element to the range of 2 μm to 20 μm. When a high-speed shearing dispersing device is used, the rotational speed is normally 1,000 rmp to 30,000 rpm, preferably 5,000 rmp to 20,000 rpm, although not particularly limited. The length of time for which the dispersion lasts is normally 0.1 min to 5 min in the case of a batch method, although not particularly limited. The temperature at the time of dispersion is normally 0° C. to 150° C. (under pressure), preferably 40° C. to 98° C.

(iii) At the same time as the production of an emulsion, a reaction with the isocyanate group-containing polyester prepolymer (A) is conducted.

This reaction involves elongating and/or cross-linking a molecular chain. The length of time for which the reaction lasts is selected according to the reactivity between the isocyanate group structure of the polyester prepolymer (A) and the amine (B) and is normally 10 min to 40 hr, preferably 2 hr to 24 hr. The reaction temperature is normally 0° C. to 150° C., preferably 40° C. to 98° C. Additionally, a known catalyst may be used in accordance with the necessity. Specific examples thereof include dibutyltin laurate and dioctyltin laurate.

(iv) After the reaction has finished, the organic solvent is removed from the emulsified dispersion element (reactant), which is followed by a washing process and a drying process, and toner base particles are thus obtained.

To remove the organic solvent, the entire system is gradually increased in temperature while in a laminar agitated state and strongly agitated in a certain temperature range, and then the solvent is removed, which makes it possible to produce spindle-shaped toner base particles. In the case where a substance soluble in acid and alkali, such as a calcium phosphate salt, is used as a dispersion stabilizer, the substance such as a calcium phosphate salt is dissolved in an acid, e.g. hydrochloric acid, then the substance such as a calcium phosphate salt is removed from the toner base particles by washing with water, for example. Besides, its removal is possible by a process such as decomposition brought about by an enzyme.

(v) A charge controlling agent is injected into the toner base particles obtained as described above, then fine inorganic particles such as fine silica particles or fine titanium oxide particles are externally added to the toner base particles so as to obtain a toner.

The injection of the charge controlling agent and the external addition of the fine inorganic particles are carried out in accordance with a known method using a mixer or the like.

This makes it easier to obtain a toner having a small particle diameter and a sharp particle size distribution. Further, the strong agitation in the process of removing the organic solvent makes it possible to control the shape of toner particles so as to be anywhere between spheres and rugby balls and also makes it possible to control the morphology of the toner particle surface such that the surface is anywhere between a smooth surface and a ragged surface.

The volume average particle diameter (Dv) of the toner used in the copier 100C is preferably 3 μm to 8 μm, and the ratio (Dv/Dn) of the volume average particle diameter (Dv) to the number average particle diameter (Dn) of the toner is preferably in the range of 1.00 to 1.30.

The volume average particle diameter (Dv) of the toner is more preferably 3.0 μm to 7.0 μm. Generally, the smaller the particle diameter of a toner is, the more advantageous the toner is in obtaining a high-resolution and high-quality image, but the more disadvantageous the toner is in terms of transfer capability and cleaning capability. Also, when the toner has a volume average particle diameter which is so small as to be outside the above-mentioned range, use of a two-component developer may cause the toner to fuse with the carrier surface through long-term agitation in a developing device, thereby possibly reducing the chargeability of the carrier.

When the ratio (Dv/Dn) of the volume average particle diameter (Dv) to the number average particle diameter (Dn)

of the toner is in the range of 1.00 to 1.30, a high-resolution and high-quality image can be produced by the toner. Further, as for the two-component developer, variation in the particle diameter of the toner in the developer can be reduced even when consumption and supply of the toner have been repeated for a long period of time, and a favorable, stable developing property is enabled even when there has been long-term agitation in the developing device. When the ratio (Dv/Dn) is greater than 1.30, the particle diameter greatly varies from toner particle to toner particle, the behavior of the toner varies at the time of developing, etc., and the ability to reproduce fine dots is impaired, thereby making it impossible to obtain a high-quality image. The ratio (Dv/Dn) is more preferably in the range of 1.00 to 1.20, which makes it possible to obtain a more favorable image.

<Explanation of Particle Size Distribution>

To reproduce fine dots of 600 dpi or greater, the toner preferably has a volume average particle diameter of 3 μm to 8 μm. The ratio (Dv/Dn) of the volume average particle diameter (Dv) to the number average particle diameter (Dn) is preferably in the range of 1.00 to 1.30. The closer the ratio (Dv/Dn) is to 1.00, the sharper the particle size distribution is. Such a toner with a small particle diameter and a narrow particle size distribution offers a uniform distribution of toner charge amount and makes it possible to obtain a high-quality image with less background fogging and also to increase the transfer rate in an electrostatic transfer method.

Examples of a device for measuring the particle size distribution of toner particles in accordance with the Coulter counter method include COULTER COUNTER TA-II and COULTER MULTISIZER II (both of which are manufactured by Coulter Corporation). The following describes a measuring method.

First of all, 0.1 ml to 5 ml of a surfactant (preferably, alkylbenzene sulfonate) is added as a dispersant into 100 ml to 150 ml of an electrolytic aqueous solution. Here, the electrolytic aqueous solution denotes an approximately 1% NaCl aqueous solution prepared using primary sodium chloride; for example, ISOTON-II (produced by Coulter Corporation) can be used therefor. Here, 2 mg to 20 mg of a measurement sample is added. The electrolytic aqueous solution in which the sample is suspended is subjected to a dispersion treatment for approximately 1 min to 3 min using an ultrasonic wave dispersing device, then the volume and the number of toner particles are measured by the measuring device with an aperture of 100 μm, and the volume distribution and the number distribution are thereby calculated. The volume average particle diameter (Dv) and the number average particle diameter (Dn) of the toner can be calculated from the distributions obtained.

As channels, the following 13 channels are used, and particles having diameters of 2.00 μm to 40.30 μm are targeted: a channel of 2.00 μm or greater, and less than 2.52 μm; a channel of 2.52 μm or greater, and less than 3.17 μm; a channel of 3.17 μm or greater, and less than 4.00 μm; a channel of 4.00 μm or greater, and less than 5.04 μm; a channel of 5.04 μm or greater, and less than 6.35 μm; a channel of 6.35 μm or greater, and less than 8.00 μm; a channel of 8.00 μm or greater, and less than 10.08 μm; a channel of 10.08 μm or greater, and less than 12.70 μm; a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

In the toner used for the copier 100C, particles of 2 μm or less in diameter preferably occupy 1% by number to 10% by number of all particles.

The above-mentioned troublesome phenomena related to particle diameters have much to do with the fine powder content; in particular, when particles of 2 μm or less in diameter occupy more than 10% by number of all particles, the toner is problematic in terms of its attachment to the carrier and there is a problem in the case where charging stability is to be achieved at a high level. Conversely, when the toner has a particle diameter which is so large as to be outside the above-mentioned range, it is difficult to obtain a high-resolution and high-quality image, and variation in the particle diameter of the toner increases in many cases when consumption and supply of the toner in the developer have been repeated. Also, it has turned out that when the ratio of the volume average particle diameter to the number average particle diameter is greater than 1.30, similar phenomena arise.

<Method for Measuring Ratio of Particles of 2 μm or Less in Diameter>

The ratio of particles of 2 μm or less in diameter to other particles in the toner of the present invention and the degree of circularity of the toner can be measured by the flow-type particle image analyzer FPIA-2000 (manufactured by SYSMEX CORPORATION). As to a specific measuring method, 0.1 ml to 0.5 ml of a surfactant, preferably alkylbenzene sulfonate, is added as a dispersant into 100 ml to 150 ml of water in a container, from which solid impurities have previously been removed, then approximately 0.1 g to 0.5 g of a measurement sample is added. The suspension in which the sample is dispersed is subjected to a dispersion treatment for approximately 1 min to 3 min using an ultrasonic wave dispersing device, and the ratio and the degree of circularity can be calculated by measuring the shape and distribution of the toner particles using the analyzer with the dispersion liquid concentration adjusted to the range of 3,000 (number per μl) to 10,000 (number per μl).

For the toner used in the copier 100C, a substantially spherical toner whose average degree of circularity is 0.94 to 0.99 is used. Here, the degree of circularity is defined by Expression (2) below.

$$\text{Degree of circularity} = L_0/L \qquad \text{Expression (2)}$$

Figure 5A:
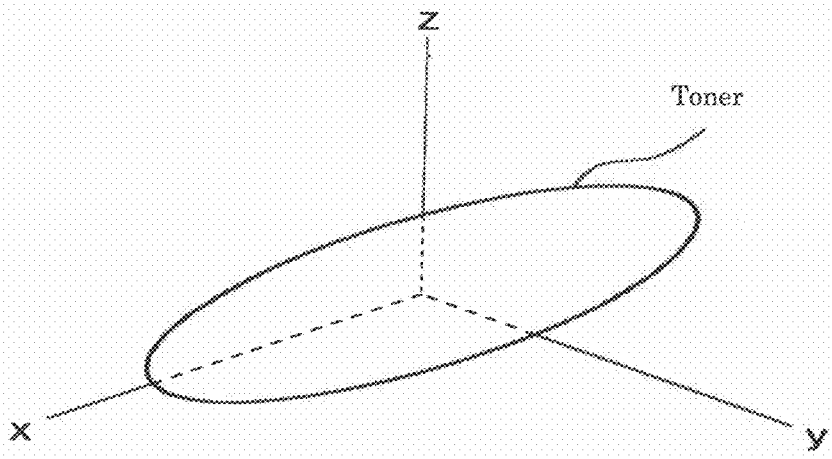
FIG. 5A is an explanatory diagram schematically showing the shape of a toner particle (Part 1).
Figure 5B:
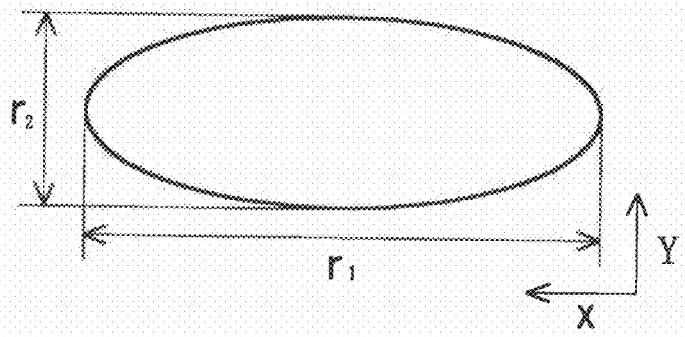
FIG. 5B is an explanatory diagram schematically showing the shape of a toner particle (Part 2).
Figure 5C:
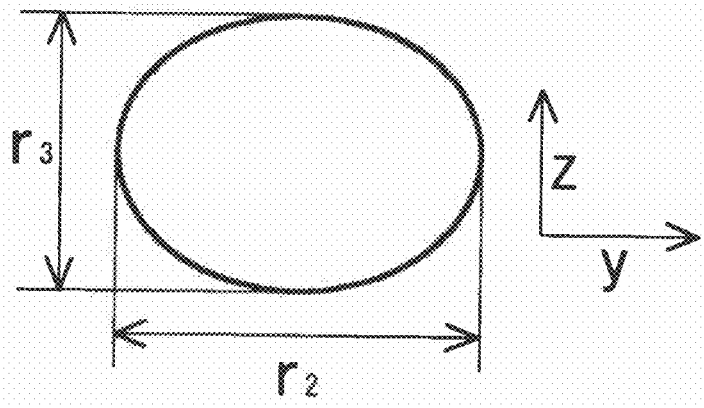
FIG. 5C is an explanatory diagram schematically showing the shape of a toner particle (Part 3).

$L_0$: circumferential length of a circle having the same area as a projected image of a particle L: circumferential length of a projected image of a particle FIGS. 5A to 5C are diagrams each schematically showing the shape of a toner particle in the toner used for the copier 100C. As to these figures, when the lengths of the substantially spherical toner particle in each direction are respectively defined as r1 concerning the major axis, r2 concerning the minor axis, and r3 concerning the thickness (r1≥r2≥r3), the toner particle has the following features: the ratio (r2/r1) of the major axis to the minor axis (see FIG. 5B) is preferably in the range of 0.5 to 1.0, and the ratio (r3/r2) of the thickness to the minor axis (see FIG. 5C) is preferably in the range of 0.7 to 1.0. When the ratio (r2/r1) of the major axis to the minor axis is less than 0.5, the shape of the toner particle differs from a sphere, so that the toner is inferior in dot reproducing ability and transfer efficiency, and thus a high-quality image cannot be obtained. When the ratio (r3/r2) of the thickness to the minor axis is less than 0.7, the toner particle almost has a flat shape, and thus a high transfer rate cannot be obtained as opposed to a spherical toner. In particular, when the ratio (r3/r2) of the thickness to the minor axis is 1.0, the toner particle becomes a rotating member with its major axis serving as a rotating axis, and thus the fluidity of the toner can be improved.

The above-mentioned r1, r2 and r3 can, for example, be measured in accordance with the following method. The toner is evenly dispersed and attached onto a flat measurement surface, 100 toner particles therein are magnified by a factor of 500 using the color laser microscope VK-8500 (manufactured by KEYENCE CORPORATION), and each of the 100 toner particles is measured for its major axis r1(μm), minor axis r2(μm) and thickness r3(μm), whose arithmetic mean values make it possible to calculate r1, r2 and r3.

As to the toner used in the copier 100C, since fine particles having suitable properties are present on the surface of toner particles, an appropriate space is formed between the toner particles and a target. Also, the fine particles come into contact with the toner particles, the photoconductors and the charging members in very small areas and evenly; therefore, there is a great effect of reducing adhesion, and the developing and transfer efficiency can be effectively improved.

Moreover, the fine particles serve as rollers, and thus the photoconductors are not abraded or damaged; even at the time of cleaning with high stress (e.g. high load, high speed) being applied between cleaning blades and the photoconductors, the fine particles are not easily embedded in the toner particles, or the fine particles may be slightly embedded in the toner particles but can detach and return therefrom, and thus stable properties can be obtained for a long period of time.

Furthermore, the fine particles appropriately detach from the toner particle surface and accumulate on ends of the cleaning blades, and thus the toner can be effectively prevented from passing the blades by the so-called dam effect.

Since these properties produce an effect of reducing the extent to which the toner particles undergo shearing, there is produced an effect of preventing the toner from undergoing filming caused by low-rheology components contained in the toner for high-speed fixation (low-energy fixation).

Examples of inorganic compounds for the fine particles of the present invention include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)n$, $Al_2O_3.2SiO_2$, $CaCO_2$, $MgCO_2$, $BaSO_4$, $MgSO_4$ and $SrTiO_3$, with preference being given to $SiO_2$, $TiO_2$ and $Al_2O_3$. These inorganic compounds, in particular, may be hydrophobized using a coupling agent, hexamethyldisilazane, dimethyldichlorosilane, octyltrimethoxysilane or the like.

Organic compounds for the fine particles of the present invention may be thermoplastic resins or thermosetting resins, and examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. For the fine resin particles, any two or more of these resins may be used in combination. Among these resins, preference is given to vinyl resins, polyurethane resins, epoxy resins, polyester resins, and combinations thereof because an aqueous dispersion element of fine spherical resin particles can be easily obtained.

Specific examples of the vinyl resins include polymers which are each produced by homopolymerizing or copolymerizing a vinyl monomer, such as styrene-(meth)acrylic acid ester copolymers, styrene-butadiene copolymers, (meth) acrylic acid-acrylic acid ester copolymers, styrene-acrylonitrile copolymers, styrene-maleic anhydride copolymers and styrene-(meth)acrylic acid copolymers.

The bulk density of the fine particles was measured in accordance with the following method. Into a 100 ml measuring cylinder, the fine particles were gradually added until they measured 100 ml.

On that occasion, vibration was not applied. The bulk density was measured by means of the difference between the mass of the measuring cylinder before the fine particles were added and the mass of the measuring cylinder after the fine particles were added.

Bulk density [g/cm$^3$]=Amount of fine particles [g/100 ml]+100

Methods for attaching fine particles onto the toner particle surface by external addition include a method in which toner base particles and fine particles are mechanically mixed together using a known mixing device and thusly attached onto each other, and a method in which toner base particles and fine particles are evenly dispersed in a liquid phase, using a surfactant or the like, then the toner base particles and the fine particles are attached onto each other and subsequently dried.

EXAMPLES

Example

Next, specific examples of the toner used in the copier 100C of the present embodiment will be explained. It should, however, be noted that the present invention is not confined to these examples.

Example 1

First of all, a method for producing a toner used in a first example (hereinafter referred to as "Example 1") of the copier 100C is described.

<Synthesis of Unmodified Polyester>

Into a reactor equipped with a cooling tube, an agitator and a nitrogen-introducing tube, 229 parts by mass of an ethylene oxide (2 mol) adduct of bisphenol A, 529 parts by mass of a propion oxide (3 mol) adduct of bisphenol A, 208 parts by mass of terephthalic acid, 46 parts by mass of adipic acid and 2 parts by mass of dibutyltin oxide were poured, and these ingredients were subjected to reaction at 230° C. under normal pressure for 8 hr. Next, the ingredients were subjected to reaction under a reduced pressure of 10 mmHg to 15 mmHg for 5 hr, then at 180° C. under normal pressure for 2 hr with the addition of 44 parts by mass of trimellitic anhydride into the reactor, and an unmodified polyester resin (1) was thus synthesized.

The unmodified polyester resin obtained had a number average molecular weight of 2,500, a weight average molecular weight of 6,700, a glass transition temperature of 43° C. and an acid value of 25 mgKOH/g.

<Method for Producing Master Batch>

Using HENSCHEL MIXER (produced by Mitsui Mining Co., Ltd.), 1,200 parts by mass of water, 540 parts by mass of PRINTEX 35 as a carbon black (produced by Degussa; DBP oil absorption=42 ml/100 mg, pH=9.5) and 1,200 parts by mass of the unmodified polyester resin (1) were mixed together. The obtained mixture was kneaded at 150° C. for 30 min using two rollers, then the mixture was cooled while extended under pressure, and was pulverized with a pulverizer (manufactured by Hosokawa Micron Group), and a master batch (1) was thus prepared.

<Production of Wax Dispersion Liquid>

In a reaction container equipped with a stirrer and a thermometer, 378 parts by mass of the unmodified polyester resin (1), 110 parts by mass of carnauba wax, 22 parts by mass of E-84 as a salicylic acid metal complex (produced by Orient Chemical Industries) and 947 parts by mass of ethyl acetate were placed, and these ingredients were heated to 80° C. while stirred, and were kept at 80° C. for 5 hr, then cooled to 30° C. in 1 hr. Subsequently, 500 parts by mass of the master batch (1) and 500 parts by mass of ethyl acetate were placed in the reaction container and mixed for 1 hr, and a raw material solution (1) was thus obtained.

Next, 1,324 parts by mass of the obtained raw material solution (1) was moved to a reaction container, where 0.5 mm zirconia beads were supplied using ULTRA VISCO MILL (manufactured by IMEX Co., Ltd.) as a bead mill so as to occupy 80% by volume, the raw material solution (1) was subjected to three passes at a solution feed rate of 1 kg/hr and a disk circumferential velocity of 6 m/sec, and carbon black and carnauba wax were dispersed therein. A wax dispersion liquid (1) was thus obtained.

<Production of Toner Material Dispersion Liquid>

Next, 1,324 parts by mass of a 65% ethyl acetate solution of the unmodified polyester resin (1) was added to the wax dispersion liquid (1). To 200 parts by mass of a dispersion liquid obtained by subjecting the above-mentioned mixture to one pass with the use of ULTRA VISCO MILL under a condition similar to the above-mentioned condition, 1.7 parts by mass of a montmorillonite (CLAYTONE APA, produced by Southern Clay Products, Inc.) as a layered inorganic mineral, at least part of which was modified with a benzyl group-containing quaternary ammonium salt, was added. Then the ingredients were agitated for 30 min using T.K. HOMODISPER (manufactured by Tokushukika Kogyo Co., Ltd.), and a toner material dispersion liquid (1) was thus obtained.

The viscosity of the toner material dispersion liquid obtained was measured in the following manner.

A gap was set at 30 μm using the parallel plate type rheometer AR2000 (manufactured by TA Instruments. Japan) incorporating a parallel plate of 20 mm in diameter, and shearing force was applied to the toner material dispersion liquid at a shearing speed of 30,000 $sec^{-1}$ at 25° C. for 30 sec; thereafter, the viscosity (viscosity A) of the toner material dispersion liquid, which is the viscosity when the shearing speed was changed from 0 $sec^{-1}$ to 70 $sec^{-1}$ in 20 sec, was measured.

Also, using the parallel plate type rheometer AR2000, the viscosity (viscosity B) of the toner material dispersion liquid, which is the viscosity when shearing force was applied to the toner material dispersion liquid at a shearing speed of 30,000 $sec^{-1}$ at 25° C. for 30 sec, was measured.

<Synthesis of Intermediate Polyester Resin>

In a reaction container equipped with a cooling tube, an agitator and a nitrogen-introducing tube, 682 parts by mass of an ethylene oxide (2 mol) adduct of bisphenol A, 81 parts by mass of a propylene oxide (2 mol) adduct of bisphenol A, 283 parts by mass of terephthalic acid, 22 parts by mass of trimellitic anhydride and 2 parts by mass of dibutyltin oxide were placed, and these ingredients were subjected to reaction at 230° C. under normal pressure for 8 hr. Subsequently, the ingredients were subjected to reaction under a reduced pressure of 10 mmHg to 15 mmHg for 5 hr, and an intermediate polyester resin was thus synthesized.

The intermediate polyester resin obtained had a number average molecular weight of 2,100, a weight average molecular weight of 9,500, a glass transition temperature of 55° C., an acid value of 0.5 mgKOH/g and a hydroxyl value of 51 mgKOH/g.

<Synthesis of Prepolymer>

Next, in a reaction container equipped with a cooling tube, an agitator and a nitrogen-introducing tube, 410 parts by mass of the intermediate polyester resin, 89 parts by mass of isophorone diisocyanate and 500 parts by mass of ethyl acetate were placed, and these ingredients were subjected to reaction at 100° C. for 5 hr so as to synthesize a prepolymer (1). The obtained prepolymer had a free isocyanate content of 1.53% by mass.

<Preparation of Oil Phase Mixture Solution>

In a reaction container equipped with a stirrer and a thermometer, 170 parts by mass of isophoronediamine and 75 parts by mass of methyl ethyl ketone were placed, and these ingredients were subjected to reaction at 50° C. for 5 hr so as to synthesize a ketimine compound. The obtained ketimine compound had an amine value of 418 mgKOH/g.

In the reaction container, 749 parts by mass of the toner material dispersion liquid (1), 115 parts by mass of the prepolymer (1) and 2.9 parts by mass of the ketimine compound were placed, then these ingredients were mixed at a rotational speed of 5,000 rpm for 1 min using TK HOMOMIXER (manufactured by Tokushukika Kogyo Co., Ltd.), and an oil phase mixture solution (1) was thus obtained.

<Method for Measuring Casson Yield Value of Oil Phase Mixture Solution (1)>

The Casson yield value was able to be measured using a high-shear viscometer or the like.

The measurement conditions were as follows.

Device: AR2000 (manufactured by TA Instruments)

Shear stress: 120 [Pa/5 min]

Geometry: 40 mm steel plate

Geometry gap: 1 mm

Analysis software: TA DATA ANALYSIS (manufactured by TA Instruments)

<Polymerization of Resin Particle Dispersion Liquid>

In a reaction container equipped with a stirrer and a thermometer, 683 parts by mass of water, 11 parts by mass of ELEMINOL RS-30 (produced by Sanyo Chemical Industries, Ltd.) as a reactive emulsifier (sodium salt of a sulfuric acid ester of an ethylene oxide adduct of methacrylic acid), 83 parts by mass of styrene, 83 parts by mass of methacrylic acid, 110 parts by mass of butyl acrylate and 1 part by mass of ammonium persulfate were placed, and these ingredients were stirred at a rotational speed of 400 rpm for 15 min so as to obtain an emulsion. The emulsion was heated to 75° C. and subjected to reaction for 5 hr. Subsequently, with addition of 30 parts by mass of a 1% ammonium persulfate aqueous solution, the emulsion was aged at 75° C. for 5 hr, and a resin particle dispersion liquid was thus prepared.

<Particle Diameter and Particle Size Distribution of Dispersoid in Toner Material Solution>

As to the toner used in the copier 100C, the particle diameter and the particle size distribution of a dispersoid in a toner material solution were measured using MICROTRAC UPA-150 (manufactured by NIKKISO CO., LTD.), and the data was analyzed using the analysis software MICROTRAC PARTICLE SIZE ANALYZER ver. 10.1.2-016EE (manufactured by NIKKISO CO., LTD.). Specifically, the toner material solution and the solvent used in the preparation thereof were added in this order into a 30 ml sample vial made of glass, and a 10% dispersion liquid was thus prepared. The dispersion liquid prepared was subjected to a dispersion treatment in 2 min using the ultrasonic wave dispersing device W-113MK-II (manufactured by HONDA ELECTRONICS).

The background was measured by means of the solvent used in the toner material solution for measurement, then the above-mentioned dispersion liquid was applied dropwise, and the particle diameter of the dispersoid was measured, with the sample loading value of the measuring device kept in the range of 1 to 10. In this measuring method, it is important in terms of the measurement reproducibility of the dispersoid particle diameter that the measurement be carried out with the sample loading value of the measuring device kept in the range of 1 to 10. To obtain a sample loading value in this range, it is necessary to adjust the amount of the dispersion liquid applied dropwise.

The measurement and analysis conditions were set as follows.

Display of distribution: volume, selection of division of particle diameter: standard, number of channels: 44, measuring time: 60 sec, number of measurements: 1, particle permeability: permeable, refractive index of particles: 1.5, shape of particles: nonspherical, density: 1 g/cm$^3$. As the value of the refractive index of the solvent, the value concerning the solvent used in the toner material solution among the values described in "Guidelines on Input Condition at The Time of Measurement" published by NIKKISO CO., LTD was employed.

(Preparation of Emulsified Slurry)

An aqueous medium was obtained by mixing and agitating 990 parts by mass of water, 83 parts by mass of a resin particle dispersion liquid, 37 parts by mass of ELEMINOL MON-7 (produced by Sanyo Chemical Industries, Ltd.) as a 48.5% aqueous solution of sodium dodecyl diphenyl ether disulfonate, 135 parts by mass of CELLOGEN BS-H-3 (produced by Dai-ichi Kogyo Seiyaku Co., Ltd.) as a polymeric dispersant that is a 1% aqueous solution of sodium carboxymethylcellulose, and 90 parts by mass of ethyl acetate. To 1,200 parts by mass of the aqueous medium, 867 parts by mass of an oil phase mixture solution was added, then the ingredients were mixed at a rotational speed of 13,000 rpm for 20 min using TK HOMOMIXER, and a dispersion liquid (emulsified slurry) (1) was thus prepared.

Next, in a reaction container equipped with an agitator and a thermometer, the emulsified slurry (1) was placed, then the solvent was removed at 30° C. in 8 hr; thereafter, the emulsified slurry (1) was aged at 45° C. for 4 hr, and a dispersion slurry (1) was thus obtained.

After 100 parts by mass of the dispersion slurry had been filtered under reduced pressure, 100 parts by mass of ion-exchange water was added to the filter cake, and the ingredients were mixed together at a rotational speed of 12,000 rpm for 10 min using TK HOMOMIXER and then filtered.

To the filter cake obtained, 10% hydrochloric acid was added so as to adjust the pH to 2.8, and the ingredients were mixed at a rotational speed of 12,000 rpm for 10 min using TK HOMOMIXER and then filtered.

Further, to the filter cake obtained, 300 parts by mass of ion-exchange water was added, and the ingredients were mixed at a rotational speed of 12,000 rpm for 10 min using TK HOMOMIXER and then filtered twice. A final filter cake was thus obtained.

The final filter cake obtained was dried at 45° C. for 48 hr using a circulation dryer and filtered through a mesh of 75 μm in sieve mesh size, and toner base particles were thus obtained.

To 100 parts by mass of the toner base particles obtained, 1.0 part by mass of large particle size silica (BET specific surface area: 21 m$^2$/g, water content: 0.4%, bulk density: 0.140 g/cm$^3$), 1.5 parts by mass of small particle size silica (BET specific surface area: 140 m$^2$/g, water content: 0.4%, bulk density: 0.140 g/cm$^3$), and 0.5 parts by mass of hydrophobized titanium oxide were added as external additives, then the ingredients were mixed using HENSCHEL MIXER (produced by Mitsui Mining Co., Ltd.), and a toner was thus produced.

The average degree of circularity, the volume average particle diameter Dv, the number average particle diameter Dn, the number of particles of 2 μm or less in diameter, and the bulk density concerning the toner produced were measured in accordance with the following methods.

<Method for Measuring Average Degree of Circularity>

In the present invention, ultrafine powder toner was measured in a flow-type particle image analyzer (FPIA-2100, manufactured by SYSMEX CORPORATION), and data was analyzed using an analysis software (FPIA-2100 DATA PROCESSING PROGRAM FOR FPIA Version 00-10). Specifically, into a 100 ml glass beaker, 0.1 ml to 0.5 ml of a 10% (by mass) surfactant (NEOGEN SC-A, which is an alkylbenzene sulfonate, produced by Dai-ichi Kogyo Seiyaku Co., Ltd.) was added, 0.1 g to 0.5 g of the toner was added, the ingredients were stirred using a microspatula, then 80 ml of ion-exchange water was added. The obtained dispersion liquid was subjected to a dispersion treatment for 3 min using an ultrasonic wave dispersing device (manufactured by HONDA ELECTRONICS). Using FPIA-2100 mentioned above, the shape and distribution of toner particles were measured until a concentration of 5,000 (number per μl) to 15,000 (number per μl) was obtained regarding the dispersion liquid. In this measuring method, it is important in terms of reproducibility in measuring the average degree of circularity that the above-mentioned dispersion liquid concentration be kept in the range of 5,000 (number per μl) to 15,000 (number per μl). To obtain the above-mentioned dispersion liquid concentration, it is necessary to change the conditions of the dispersion liquid, namely the amount of the surfactant added and the amount of the toner. As in the above-mentioned measurement of the particle diameter of the toner, the required amount of the surfactant varies depending upon the hydrophobicity of the toner; when the surfactant is added in large amounts, noise is caused by foaming, and when the surfactant is added in small amounts, the toner cannot be sufficiently wetted, thereby leading to insufficient dispersion. Also, the amount of the toner added varies depending upon its particle diameter; when the toner has a small particle diameter, it needs to be added in small amounts, and when the toner has a large particle diameter, it needs to be added in large amounts. In the case where the toner particle diameter is 3 μm to 7 μm, the dispersion liquid concentration can be adjusted to the range of 5,000 (number per μl) to 15,000 (number per μl) by adding 0.1 g to 0.5 g of the toner.

<Method for Measuring Volume Average Particle Diameter Dv and Number Average Particle Diameter Dn>

The volume average particle diameter (Dv) and the number average particle diameter (Dn) of the toner of the present invention were measured using a particle size measuring device (MULTISIZER III, manufactured by Beckman Coulter, Inc.) with an aperture diameter of 100 μm, and the data was analyzed using an analysis software (Beckman Coulter Mutlisizer 3 Version 3.51). Specifically, into a 100 ml glass beaker, 0.5 ml of a 10% (by mass) surfactant (NEOGEN SC-A, which is an alkylbenzene sulfonate, produced by Dai-ichi Kogyo Seiyaku Co., Ltd.) was added, 0.5 g of the toner was added, the ingredients were stirred using a microspatula, then 80 ml of ion-exchange water was added. The obtained dispersion liquid was subjected to a dispersion treatment for 10 min using an ultrasonic wave dispersing device (W-113MK-II, manufactured by HONDA ELECTRONICS).

The dispersion liquid was measured in MULTISIZER III mentioned above, with ISOTON III (produced by Beckman Coulter, Inc.) used as a solution for measurement. In the measurement, the toner sample dispersion liquid was applied dropwise such that the concentration shown by the device stood at 8%±2%. In this measuring method, it is important in terms of reproducibility in measuring the particle diameter that the concentration be 8%±2%. When the concentration is in this range, an error in particle diameter can be prevented.

<Method for Measuring Number of Particles of 2 μm or Less in Diameter>

The ratio of particles of 2 μm or less in diameter to other particles in the toner of the present invention and the degree of circularity of the toner can be measured by the flow-type particle image analyzer FPIA-2000 (manufactured by SYSMEX CORPORATION). As to a specific measuring method, 0.1 ml to 0.5 ml of a surfactant, preferably alkylbenzene sulfonate, is added as a dispersant into 100 ml to 150 ml of water in a container, from which solid impurities have previously been removed, then approximately 0.1 g to 0.5 g of a measurement sample is added. The suspension in which the sample is dispersed is subjected to a dispersion treatment for approximately 1 min to 3 min using an ultrasonic wave dispersing device, and the ratio and the degree of circularity can be calculated by measuring the shape and distribution of the toner particles using the analyzer with the dispersion liquid concentration adjusted to the range of 3,000 (number per μl) to 10,000 (number per μl).

<Method for Measuring Bulk Density>

The bulk density of the fine particles was measured in accordance with the following method. Into a 100 ml measuring cylinder, the fine particles were gradually added until they measured 100 ml.

On that occasion, vibration was not applied. The bulk density was measured by means of the difference between the mass of the measuring cylinder before the fine particles were added and the mass of the measuring cylinder after the fine particles were added.

$$\text{Bulk density [g/cm}^3\text{]} = \text{Amount of fine particles [g/100 ml]} \div 100$$

The produced toner was evaluated for an image formed thereof, in accordance with the following method.

<Image Evaluation Method>

1. A toner to be evaluated and an entire apparatus were left to stand for one day in a room having a temperature of 25° C. and a relative humidity of 50%.
2. All toner in the PCU of the copier 100C was removed, such that only a carrier was left in the developing device 61.
3. Into the developing device 61 where only the carrier was present, 28 g of a black toner as a sample was poured, and 400 g of a developer having a toner concentration of 7% was produced.
4. The developing device 61 was installed in the main body of the copier 100C, and only the developing device 61 was idled for 5 min at a developing sleeve (sleeve which formed the surface of the developing roller 61*a*) linear velocity of 300 mm/s.
5. The developing sleeve and the photoconductor 10 were both rotated by trailing at a target linear velocity, and the charge potential and a developing bias were adjusted such that the amount of the toner on the photoconductor 10 became 0.4±0.05 mg/cm$^2$.
6. Under the above-mentioned developing conditions, a transfer current was adjusted such that the transfer rate became 96%±2%.
7. Entire-surface solid images were continuously output for 50 sheets.
8. The number of fireflies in each of the output entire-surface solid images was counted, and the average number of fireflies per sheet was calculated.

Example 2

In a second example (hereinafter referred to as "Example 2") of the copier 100C, a toner was produced similarly to that in Example 1, except that the amount of the modified layered inorganic mineral (product name: CLAYTONE APA) was changed from 1.7 parts by mass to 1.3 parts by mass and the amount of the small particle size silica was changed from 1.5 parts by mass to 1.0 part by mass.

Example 3

In a third example (hereinafter referred to as "Example 3") of the copier 100C, a toner was produced similarly to that in Example 1, except that the amount of the modified layered inorganic mineral (product name: CLAYTONE APA) was changed from 1.7 parts by mass to 1.0 part by mass and the amount of the small particle size silica was changed from 1.5 parts by mass to 0.5 parts by mass.

Example 4

In a fourth example (hereinafter referred to as "Example 4") of the copier 100C, a toner was produced similarly to that in Example 1, except that the amount of the small particle size silica was changed from 1.5 parts by mass to 0.9 parts by mass.

Example 5

In a fifth example (hereinafter referred to as "Example 5") of the copier 100C, a toner was produced similarly to that in Example 2, except that the amount of the small particle size silica was changed from 1.0 part by mass to 0.7 parts by mass.

Example 6

In a sixth example (hereinafter referred to as "Example 6") of the copier 100C, a toner was produced similarly to that in Example 3, except that the amount of the small particle size silica was changed from 0.5 parts by mass to 0.4 parts by mass.

Example 7

In a seventh example (hereinafter referred to as "Example 7") of the copier 100C, a toner was produced similarly to that in Example 1, except that the amount of the small particle size silica was changed from 1.5 parts by mass to 1.7 parts by mass.

Example 8

In an eighth example (hereinafter referred to as "Example 8") of the copier 100C, a toner was produced similarly to that in Example 2, except that the amount of the small particle size silica was changed from 1.0 part by mass to 1.2 parts by mass.

Example 9

In a ninth example (hereinafter referred to as "Example 9") of the copier 100C, a toner was produced similarly to that in Example 3, except that the amount of the small particle size silica was changed from 0.5 parts by mass to 0.3 parts by mass.

Example 10

In a tenth example (hereinafter referred to as "Example 10") of the copier 100C, a toner was produced similarly to that in Example 1, except that the amount of the modified layered inorganic mineral (product name: CLAYTONE APA) was changed from 1.7 parts by mass to 1.5 parts by mass and the amount of the small particle size silica was changed from 1.5 parts by mass to 1.4 parts by mass.

Example 11

In an eleventh example (hereinafter referred to as "Example 11") of the copier 100C, a toner was produced similarly to that in Example 1, except that the amount of the modified layered inorganic mineral (product name: CLAYTONE APA) was changed from 1.7 parts by mass to 1.2 parts by mass and the amount of the small particle size silica was changed from 1.5 parts by mass to 0.6 parts by mass.

Example 12

In a twelfth example (hereinafter referred to as "Example 12") of the copier 100C, a toner was produced similarly to that in Example 1, except that the amount of the modified layered inorganic mineral (product name: CLAYTONE APA) was changed from 1.7 parts by mass to 1.9 parts by mass and the amount of the small particle size silica was changed from 1.5 parts by mass to 1.8 parts by mass.

Example 13

A thirteenth example (hereinafter referred to as "Example 13") of the copier 100C employed a toner produced in accordance with the following production method.

(Preparation of Resin Emulsion)

A monomer mixture solution was produced by uniformly mixing the following monomers.

| | |
|---|---|
| Styrene monomer | 71 parts by mass |
| n-butyl acrylate | 25 parts by mass |
| Acrylic acid | 4 parts by mass |

The following aqueous solution mixture was placed in a reactor and heated to 70° C. while agitated. In an agitated state with the temperature of the solution kept at 70° C., the monomer mixture solution and 5 parts by mass of a 1% aqueous solution of potassium persulfate were simultaneously applied dropwise in 4 hr, then the ingredients were polymerized at 70° C. in 2 hr, and a resin emulsion having a solid content of 50% was thus obtained.

| | |
|---|---|
| Water | 100 parts by mass |
| Nonionic emulsifier (EMALGEN 950) | 1 part by mass |
| Anionic emulsifier (NEOGEN R) | 1.5 parts by mass |

(Preparation of Toner Particles)

The following mixture was agitated for 2 hr using a dispersing device, with the temperature kept at 25° C.

| | |
|---|---|
| Pigment | 20 parts by mass |
| Charge controlling agent (E-84, produced by Orient Chemical Industries) | 1 part by mass |
| Anionic emulsifier (NEOGEN R) | 0.5 parts by mass |
| Water | 310 parts by mass |

Subsequently, 188 parts by mass of the above-mentioned emulsion was added to this dispersion liquid, the ingredients were agitated for approximately 2 hr, then heated to 60° C. and adjusted to 7.0 in pH by ammonia. Further, this dispersion liquid was heated to 90° C., then this temperature was kept for 2 hr, and a dispersion slurry 1 was thus obtained.

After 100 parts by mass of the dispersion slurry 1 had been filtered under reduced pressure, the following took place.

(1) To the filter cake, 100 parts by mass of ion-exchange water was added, and the ingredients were mixed (at a rotational speed of 12,000 rpm for 10 min) using TK HOMOMIXER and then filtered.

(2) To the filter cake of (1), 10% hydrochloric acid was added so as to adjust the pH to 2.8, and the ingredients were mixed (at a rotational speed of 12,000 rpm for 10 min) using TK HOMOMIXER and then filtered.

(3) To the filter cake of (2), 300 parts by mass of ion-exchange water was added, and the ingredients were mixed (at a rotational speed of 12,000 rpm for 10 min) using TK HOMOMIXER and then filtered twice. A filter cake 1 was thus obtained.

The filter cake 1 was dried at 45° C. for 48 hr using a circulation dryer and filtered through a mesh of 75 μm in sieve mesh size, and a toner having a weight average particle diameter of 5.9 μm was thus obtained. Further, 1.2 parts by mass of R972 (silica produced by NIPPON AEROSIL CO., LTD., average primary particle diameter: 0.016 μm, BET specific surface area: 150 $m^2/g$) was externally added as small particle size silica per 100 parts by mass of the toner, and a toner was thus obtained.

Example 14

In a fourteenth example (hereinafter referred to as "Example 14") of the copier 100C, a toner was produced similarly to that in Example 13, except that the length of time for which the dispersion liquid was heated at 90° C. so as to obtain the dispersion slurry 1 was changed to 5 hr, and that the amount of the small particle size silica was changed from 1.2 parts by mass to 0.8 parts by mass.

Comparative Example 1

Next, a method for producing a toner used in a first comparative example (hereinafter referred to as "Comparative Example 1") to be compared with the above-mentioned Examples, using the copier 100C, will be described.

As opposed to Example 1, in producing the toner material dispersion liquid, the montmorillonite (CLAYTONE APA, produced by Southern Clay Products, Inc.) as a layered inorganic mineral, at least part of which was modified with a benzyl group-containing quaternary ammonium salt, was not added; in preparing the emulsified slurry, the solvent was removed from the emulsified slurry (1) at 30° C. and the amount of residual ethyl acetate in the emulsified slurry was adjusted to 6% by mass. Placed in a container, 100 parts by mass of the emulsified slurry from which the solvent had been removed and 0.71 parts by mass of carboxymethylcellulose (CMC DAICEL-1280, produced by DAICEL CHEMICAL INDUSTRIES, LTD.) were mixed together using a paddle-type stirring blade, at a circumferential velocity of 1.8 m/s for 1 hr. Further, the amount of the small particle size silica was changed to 0.25 parts by mass. Except for these points, the toner in Comparative Example 1 was produced similarly to that in Example 1.

Comparative Example 2

In a second comparative example (hereinafter referred to as "Comparative Example 2") employing the copier 100C, a toner was produced similarly to that in Comparative Example 1, except that the amount of the carboxymethylcellulose (CMC DAICEL-1280, produced by DAICEL CHEMICAL INDUSTRIES, LTD.) was changed from 0.71 parts by mass to 1 part by mass and the amount of the small particle size silica was changed to 0.1 parts by mass.

Comparative Example 3

A method for producing a toner used in a third comparative example (hereinafter referred to as "Comparative Example 3") employing the copier 100C is as follows.

The toner in Comparative Example 3 was produced similarly to that in Example 1, except that the modified layered inorganic mineral (product name: CLAYTONE APA) was changed to an organosilica sol (MEK-ST-UP, solid content concentration: 20%, average primary particle diameter: 15 nm, produced by Nissan Chemical Industries, Ltd.), with the amount of the organosilica sol being 20 parts by mass, and that the amount of the small particle size silica was changed to 1.8 parts by mass.

Comparative Example 4

In a fourth comparative example (hereinafter referred to as "Comparative Example 4") employing the copier 100C, a toner was produced similarly to that in Comparative Example 3, except that the amount of the organosilica sol (MEK-ST-UP, solid content concentration: 20%, average primary particle diameter: 15 nm, produced by Nissan Chemical Industries, Ltd.) was changed from 20 parts by mass to 15 parts by mass and the amount of the small particle size silica was changed to 2.0 parts by mass.

Comparative Example 5

In a fifth comparative example (hereinafter referred to as "Comparative Example 5") employing the copier 100C, a toner was produced similarly to that in Comparative Example 3, except that the amount of the organosilica sol (MEK-ST-UP, solid content concentration: 20%, average primary particle diameter: 15 nm, produced by Nissan Chemical Industries, Ltd.) was changed from 20 parts by mass to 10 parts by mass and the amount of the small particle size silica was changed to 1.5 parts by mass.

Comparative Example 6

In a sixth comparative example (hereinafter referred to as "Comparative Example 6") employing the copier 100C, a toner was produced similarly to that in Comparative Example 3, except that the amount of the organosilica sol (MEK-ST-UP, solid content concentration: 20%, average primary particle diameter: 15 nm, produced by Nissan Chemical Industries, Ltd.) was changed from 20 parts by mass to 12 parts by mass and the amount of the small particle size silica was changed to 0.6 parts by mass.

Comparative Example 7

In a seventh comparative example (hereinafter referred to as "Comparative Example 7") employing the copier 100C, a toner was produced similarly to that in Comparative Example 3, except that the amount of the organosilica sol (MEK-ST-UP, solid content concentration: 20%, average primary particle diameter: 15 nm, produced by Nissan Chemical Industries, Ltd.) was changed from 20 parts by mass to 8 parts by mass and the amount of the small particle size silica was changed to 1.0 part by mass.

Comparative Example 8

In an eighth comparative example (hereinafter referred to as "Comparative Example 8") employing the copier 100C, a toner was produced similarly to that in Comparative Example 3, except that the amount of the organosilica sol (MEK-ST-UP, solid content concentration: 20%, average primary particle diameter: 15 nm, produced by Nissan Chemical Industries, Ltd.) was changed from 20 parts by mass to 5 parts by mass and the amount of the small particle size silica was changed to 1.3 parts by mass.

The properties of the toners of Examples 1 to 14 and Comparative Examples 1 to 8 are shown in Table 1.

TABLE 1

| | Properties of toner | | | | |
|---|---|---|---|---|---|
| | Casson yield value (Pa) | Average degree of circularity | Volume average particle diameter μm | Dv/Dn (—) | Number of particles of 2 μm or less in diameter (% by number) |
| Example 1 | 1.6 | 0.948 | 5.2 | 1.14 | 9.5 |
| Example 2 | 2.2 | 0.962 | 5.3 | 1.14 | 4.6 |
| Example 3 | 6.6 | 0.984 | 5.3 | 1.12 | 6.2 |
| Example 4 | 1.6 | 0.948 | 5.2 | 1.14 | 9.5 |
| Example 5 | 2.2 | 0.962 | 5.3 | 1.14 | 4.6 |
| Example 6 | 6.6 | 0.984 | 5.3 | 1.12 | 6.2 |
| Example 7 | 1.6 | 0.948 | 5.2 | 1.14 | 9.5 |
| Example 8 | 2.2 | 0.962 | 5.3 | 1.14 | 4.6 |
| Example 9 | 6.6 | 0.984 | 5.3 | 1.12 | 6.2 |
| Example 10 | 1.6 | 0.955 | 5.3 | 1.13 | 5.0 |
| Example 11 | 6.6 | 0.977 | 5.2 | 1.12 | 4.3 |
| Example 12 | 1.6 | 0.941 | 5.2 | 1.12 | 4.1 |
| Example 13 | 2.4 | 0.955 | 5.5 | 1.13 | 4.3 |
| Example 14 | 6.5 | 0.973 | 5.3 | 1.14 | 5.5 |
| Comparative Example 1 | 5.7 | 0.979 | 5.4 | 1.13 | 8.4 |
| Comparative Example 2 | 4.9 | 0.951 | 5.0 | 1.12 | 8.6 |
| Comparative Example 3 | 8.4 | 0.952 | 5.3 | 1.13 | 9.1 |
| Comparative Example 4 | 9.7 | 0.955 | 5.6 | 1.12 | 4.3 |
| Comparative Example 5 | 6.3 | 0.971 | 5.5 | 1.12 | 6.4 |
| Comparative Example 6 | 4.6 | 0.956 | 5.7 | 1.12 | 4.3 |
| Comparative Example 7 | 6.1 | 0.972 | 5.3 | 1.14 | 5.2 |
| Comparative Example 8 | 6.1 | 0.982 | 5.3 | 1.13 | 4.1 |

Meanwhile, the results of image evaluations when images were formed by the copier 100C, using the toners of Examples 1 to 14 and Comparative Examples 1 to 8, are shown in Table 2.

TABLE 2

| | | Average degree of circularity | Amount of small particle size silica % by mass (relative to toner base particles) | Bulk density (g/cm$^3$) | Cleaning defect | Number of fireflies (Number) |
|---|---|---|---|---|---|---|
| Example A | Example 1 | 0.948 | 1.5 | 0.41 | A | 1.1 |
| | Example 2 | 0.962 | 1.0 | 0.43 | B | 0.7 |
| | Example 3 | 0.984 | 0.5 | 0.45 | B | 0.8 |
| | Example 4 | 0.948 | 0.9 | 0.44 | A | 1.2 |
| | Example 5 | 0.962 | 0.7 | 0.44 | A | 1.6 |
| | Example 6 | 0.984 | 0.4 | 0.45 | B | 1.5 |
| | Example 7 | 0.948 | 1.7 | 0.47 | A | 1.3 |
| | Example 8 | 0.962 | 1.2 | 0.47 | B | 1.1 |
| | Example 9 | 0.984 | 0.3 | 0.46 | B | 0.4 |
| | Example 10 | 0.955 | 1.4 | 0.46 | B | 1.7 |
| | Example 11 | 0.977 | 0.6 | 0.46 | B | 1.5 |
| | Example 12 | 0.941 | 1.8 | 0.43 | A | 1.8 |
| Example B | Example 13 | 0.955 | 1.2 | 0.43 | A | 2.1 |
| | Example 14 | 0.973 | 0.8 | 0.48 | C | 1.9 |
| Comparative Example | Comparative Example 1 | 0.979 | 0.25 | 0.45 | D | 1.4 |
| | Comparative Example 2 | 0.951 | 0.1 | 0.41 | B | 6.2 |
| | Comparative Example 3 | 0.952 | 1.8 | 0.44 | A | 2.7 |
| | Comparative Example 4 | 0.955 | 2.0 | 0.45 | D | 1.8 |
| | Comparative Example 5 | 0.971 | 1.5 | 0.51 | D | 1.2 |
| | Comparative Example 6 | 0.956 | 0.6 | 0.43 | B | 3.8 |
| | Comparative Example 7 | 0.972 | 1.0 | 0.49 | D | 1.5 |
| | Comparative Example 8 | 0.982 | 1.3 | 0.51 | D | 1.2 |

The average degrees of circularity of the toners, and the amounts of the small particle size silica added are shown all together in Table 3.

TABLE 3

| | Degree of circularity | Amount of silica added | −18A + 17.92 | B | −34A + 33.96 |
|---|---|---|---|---|---|
| Example 1 | 0.948 | 1.5 | 0.856 | 1.5 | 1.728 |
| Example 2 | 0.962 | 1.0 | 0.604 | 1.0 | 1.252 |
| Example 3 | 0.984 | 0.5 | 0.208 | 0.5 | 0.504 |
| Example 4 | 0.948 | 0.9 | 0.856 | 0.9 | 1.728 |
| Example 5 | 0.962 | 0.7 | 0.604 | 0.7 | 1.252 |
| Example 6 | 0.984 | 0.4 | 0.208 | 0.4 | 0.504 |
| Example 7 | 0.948 | 1.7 | 0.856 | 1.7 | 1.728 |
| Example 8 | 0.962 | 1.2 | 0.604 | 1.2 | 1.252 |
| Example 9 | 0.984 | 0.3 | 0.208 | 0.3 | 0.504 |
| Example 10 | 0.955 | 1.4 | 0.73 | 1.4 | 1.49 |
| Example 11 | 0.977 | 0.6 | 0.334 | 0.6 | 0.742 |
| Example 12 | 0.941 | 1.8 | 0.982 | 1.8 | 1.966 |
| Example 13 | 0.955 | 1.2 | 0.73 | 1.2 | 1.49 |
| Example 14 | 0.973 | 0.8 | 0.406 | 0.8 | 0.878 |
| Comparative Example 1 | 0.979 | 0.25 | 0.298 | 0.25 | 0.674 |
| Comparative Example 2 | 0.951 | 0.1 | 0.802 | 0.1 | 1.626 |
| Comparative Example 3 | 0.952 | 1.8 | 0.784 | 1.8 | 1.592 |
| Comparative Example 4 | 0.955 | 2.0 | 0.73 | 2.0 | 1.49 |
| Comparative Example 5 | 0.971 | 1.5 | 0.442 | 1.5 | 0.946 |
| Comparative Example 6 | 0.956 | 0.6 | 0.712 | 0.6 | 1.456 |
| Comparative Example 7 | 0.972 | 1.0 | 0.424 | 1.0 | 0.912 |
| Comparative Example 8 | 0.982 | 1.3 | 0.244 | 1.3 | 0.572 |

Appropriate ranges (ranges that do not cause problems) for each article in Table 2 are shown below.

Bulk density: 0.40 g/cm$^3$ to 0.50 g/cm$^3$

Number of fireflies: 2.5 (number) or less, preferably 2.0 (number) or less

Cleaning defect: A, B or C

A: There was no problem whatsoever.

B: Although toner slightly leaked through a blade, images were not at all problematic.

C: Toner often leaked through a blade, and the toner occasionally appeared on images.

D: Toner leaked through a blade very frequently, and the toner often appeared on images.

Figure 6:
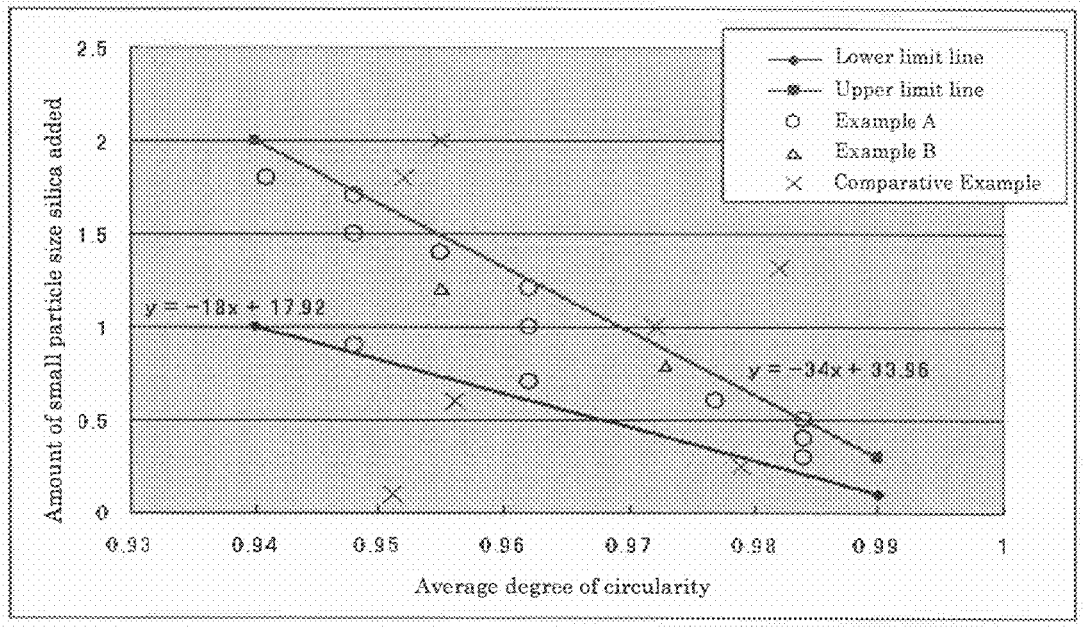
FIG. 6 is a graph on which the experimental results shown in Table 3 have been plotted.

FIG. 6 is a graph on which the average degrees of circularity and the amounts of small particle size silica concerning Examples and Comparative Examples, shown in Table 2, have been plotted, where the symbol ○ is related to Examples 1 to 12, the symbol Δ is related to Example 13 and 14, and the symbol X is related to Comparative Examples.

As shown in Table 2, as to each of Examples 1 to 12, the bulk density did not excessively rise, the cleaning capability was favorable, and the occurrence of fireflies, which stems from toner aggregates, was not noticeable and did not cause problems. Examples 13 and 14 are not sufficiently superior in prevention of the occurrence of fireflies and in cleaning capability respectively, but are not problematic.

Comparative Examples 1, 4, 5 and 7 are problematic in terms of cleaning capability, and Comparative Examples 2, 3 and 6 are problematic in terms of the occurrence of fireflies. Comparative Examples 5 and 8 are problematic in terms of cleaning capability and excessive increase in bulk density.

As shown in FIG. 6, when the average degree of circularity was represented by the horizontal axis (x-axis) and the amount of the small particle size silica added was represented by the vertical (y axis), x and y concerning all Examples satisfied the expression $-18x+17.92 \leq y \leq -34x+33.96$. Meanwhile, x and y concerning Comparative Examples 1 to 8, which caused certain troubles in image formation, did not satisfy the expression $-18x+17.92 \leq y \leq -34x+33.96$.

Accordingly, in the case where A and B concerning the toner for the copier 100C satisfy the expression $-18A+17.92 \leq B \leq -34A+33.96$ (A denotes the average degree of circularity of the toner, and B, expressed as percent by mass, denotes the amount of small particle size silica relative to the mass of toner base particles) as in Examples 1 to 14, it is possible to prevent the occurrence of cleaning defect and a rise in bulk density caused by excessive addition of small particle size silica and also to prevent the occurrence of fireflies caused by formation of toner aggregates.

Thus, according to the present embodiment, in the copier 100C that is an image forming apparatus to form an image, a toner that is produced by adding small particle size silica to toner base particles is conveyed by means of the toner supply device 500 that supplies the toner from inside the toner bottle 220, which is a toner housing container housing the toner, into the developer housing section 61*c* of the developing device 61, which houses a developer, with the use of the powder pump 2 that is a screw pump. Also, an image is formed on transfer paper, a recording medium, by developing a latent image on the photoconductor 10, a latent image bearing member, to form a toner image with the use of the developer and by transferring the toner image formed on the photoconductor 10 to the transfer paper by means of an intermediate transfer unit serving as a transfer device including the intermediate transfer belt 50. As to the toner housed in the toner bottle 220 and thusly used in the copier 100C, A and B are set to satisfy the expression $-18A+17.92 \leq B \leq -34A+33.96$, where A denotes the average degree of circularity of the toner, and B, expressed as percent by mass, denotes the amount of the small particle size silica relative to the mass of the toner base particles. This setting makes it possible to prevent the occurrence of cleaning defect and a rise in bulk density caused by excessive addition of small particle size silica and also to prevent the occurrence of fireflies caused by formation of toner aggregates. Therefore, it is possible to prevent the occurrence of image defect that stems from formation of toner aggregates inside the powder pump 2 and also to prevent the occurrence of trouble that stems from excessive addition of small particle size silica.

Also, the toner used in the copier 100C is a toner obtained by dissolving and/or dispersing in an organic solvent at least a binder resin, a prepolymer derived from a modified polyester resin, a compound capable of elongating and/or cross-linking with the prepolymer, a colorant, a releasing agent, and a modified layered inorganic mineral (in which at least part of interlayer ions are modified with organic ions) so as to prepare a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction. When the Casson yield value is less than 1 Pa, a desired form is hard to obtain. When the Casson yield value is greater than 100 Pa, the production capability degrades. Accordingly, by keeping the Casson yield value in the range of 1 Pa to 100 Pa, the occurrence of such troubles can be prevented.

Also, the toner used in the copier 100C is a toner wherein a modified layered inorganic mineral, in which at least part of interlayer ions are modified with organic ions, occupies 0.05% by mass to 10% by mass of the solid content of a solution or a dispersion liquid. When the amount of the modified layered inorganic mineral is less than 0.05% by mass, the desired Casson yield value cannot be obtained. When the amount of the modified layered inorganic mineral is greater than 10% by mass, the toner-fixing property degrades. When the modified layered inorganic mineral occupies 0.05% by mass to 10% by mass of the solid content of the solution or the dispersion liquid, it is possible to prevent such troubles.

Also, the toner used in the copier 100C is a toner wherein small particle size silica has a BET specific surface area of 140 $m^2/g$, which is within the range of 50 $m^2/g$ to 400 $m^2/g$, and the average degree of circularity A of the toner satisfies the expression $0.94 \leq A \leq 0.99$. Since the average degree of circularity A of the toner satisfies the expression $0.94 \leq A \leq 0.99$ and the toner is substantially spherical in shape, it is possible to realize desired fluidity, without excessively adding small particle size silica.

Additionally, as opposed to small particle size silica having a BET specific surface area of 50 $m^2/g$ or greater, silica having a BET specific surface area of less than 50 $m^2/g$ is generally referred to as middle particle size silica or large particle size silica. Being different from small particle size silica having a function of giving fluidity to toner, such silica mainly functions as a spacer for reducing adhesion of a photoconductor and therefore has little to do with fireflies to which the fluidity of toner is related.

Also, the toner used in the copier 100C is a toner having a volume average particle diameter (Dv) of 3 μm to 8 μm, wherein the ratio (Dv/Dn) of the volume average particle diameter (Dv) to the number average particle diameter (Dn) of the toner is in the range of 1.00 to 1.30. When the ratio (Dv/Dn) of the volume average particle diameter (Dv) to the number average particle diameter (Dn) of the toner is in the range of 1.00 to 1.30, a high-resolution and high-quality image can be produced by the toner. Further, as for the two-component developer, variation in the particle diameter of the toner in the developer can be reduced even when consumption and supply of the toner have been repeated for a long period of time, and a favorable, stable developing property is enabled even when there has been long-term agitation in the developing device 61. When the ratio (Dv/Dn) is greater than 1.30, the particle diameter greatly varies from toner particle to toner particle, the behavior of the toner varies at the time of developing, etc., and the ability to reproduce fine dots is impaired, thereby making it impossible to obtain a high-quality image.

The toner used in the copier 100C is a toner wherein particles of 2 μm or less in diameter occupy 1% by number to 10% by number of all particles. Troublesome phenomena related to particle diameters have much to do with the fine powder content; in particular, when particles of 2 μm or less in diameter occupy more than 10% by number of all particles, the toner is problematic in terms of its attachment to the carrier and there is a problem in the case where charging stability is to be achieved at a high level. Accordingly, when particles of 2 μm or less in diameter occupy 1% by number to 10% by number of all particles, the occurrence of such problems can be prevented.

Also, when any one of the toners of Examples 1 to 14 or a toner that satisfies the expression $-18A+17.92 \leq B \leq -34A+33.96$ is employed as the toner used in the copier 100C, which is an image forming apparatus, it is possible to prevent the occurrence of image defect that stems from formation of toner aggregates inside the powder pump 2 and also to prevent the occurrence of trouble that stems from excessive addition of small particle size silica.

What is claimed is:

1. An image forming method comprising:

conveying a toner by means of a toner supply device that supplies the toner from inside a toner housing container, which houses the toner, into a developer housing section of a developing device, which houses a developer, using a screw pump, and forming an image on a recording medium by developing a latent image on a latent image bearing member to form a toner image with the use of the developer and by transferring the toner image formed on the latent image bearing member to the recording medium by means of a transfer device, wherein the toner is formed by adding small particle size silica to toner base particles, and wherein when A represents the average degree of circularity of the toner, and B, expressed as percent by mass, represents the amount of the small particle size silica relative to the mass of the toner base particles, Expression (1) shown below is satisfied:

$$-18A+17.92 \leq B \leq -34A+33.96 \quad \text{Expression (1)}$$

for $0.94 \leq A \leq 0.99$, and the small particle size silica in the toner has a BET specific surface area of 50 $m^2/g$ to 400 $m^2/g$.

2. The image forming method according to claim 1, wherein the toner comprises at least a binder resin, a colorant, a releasing agent, and a modified layered inorganic mineral in which at least part of interlayer ions are modified with organic ions.

3. The image forming method according to claim 2, wherein the toner is obtained by dissolving and/or dispersing in an organic solvent at least the binder resin, a prepolymer derived from a modified polyester resin, a compound capable of elongating and/or cross-linking with the prepolymer, the colorant, the releasing agent and the modified layered inorganic mineral so as to prepare a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction.

4. The image forming method according to claim 3, wherein the modified layered inorganic mineral occupies 0.05% by mass to 10% by mass of a solid content of the solution or the dispersion liquid.

5. The image forming method according to claim 1, wherein the toner has a volume average particle diameter (Dv) of 3 μm to 8 μm, and a ratio (Dv/Dn) of the volume average particle diameter (Dv) to a number average particle diameter (Dn) of the toner is in the range of 1.00 to 1.30.

6. A toner formed by adding small particle size silica to toner base particles, wherein when A represents the average degree of circularity of the toner, and B, expressed as percent by mass, represents the amount of the small particle size silica relative to the mass of the toner base particles, Expression (1) shown below is satisfied:

$$-18A+17.92 \leq B \leq -34A+33.96 \quad \text{Expression (1)}$$

for $0.94 \leq A \leq 0.99$, and the small particle size silica in the toner has a BET specific surface area of 50 $m^2/g$ to 400 $m^2/g$.

7. The toner according to claim 6, comprising at least a binder resin, a colorant, a releasing agent, and a modified layered inorganic mineral in which at least part of interlayer ions are modified with organic ions.

8. The toner according to claim 7, obtained by dissolving and/or dispersing in an organic solvent at least the binder resin, a prepolymer derived from a modified polyester resin, a compound capable of elongating and/or cross-linking with the prepolymer, the colorant, the releasing agent and the modified layered inorganic mineral so as to prepare a solution or a dispersion liquid each having a Casson yield value of 1 Pa to 100 Pa at 25° C.; then removing a solvent from a dispersion liquid obtained by emulsifying and/or dispersing the solution or the dispersion liquid in an aqueous medium for performing elongation reaction and/or cross-linking reaction.

9. The toner according to claim 8, wherein the modified layered inorganic mineral occupies 0.05% by mass to 10% by mass of a solid content of the solution or the dispersion liquid.

10. The toner according to claim 6, having a volume average particle diameter (Dv) of 3 μm to 8 μm, wherein a ratio (Dv/Dn) of the volume average particle diameter (Dv) to a number average particle diameter (Dn) of the toner is in the range of 1.00 to 1.30.

11. An image forming apparatus comprising:

a latent image bearing member, a developing device which develops a latent image on the latent image bearing member, using a developer housed in a developer housing section of the developing device, a toner housing container which houses a toner to be supplied to the developer in the developer housing section, a toner supply device which supplies the toner in the toner housing container to the developer housing section of the developing device using a screw pump, a transfer unit configured to transfer onto a recording medium a toner image formed on the latent image bearing member through development by the developing device, and a fixing unit configured to fix the toner image on the recording medium onto which the toner image has been transferred, wherein the toner is formed by adding small particle size silica to toner base particles, and wherein when A represents the average degree of circularity of the toner, and B, expressed as percent by mass, represents the amount of the small particle size silica relative to the mass of the toner base particles, Expression (1) shown below is satisfied:

$$-18A+17.92 \leq B \leq -34A+33.96 \quad \text{Expression (1)}$$

for $0.94 \leq A \leq 0.99$, and the small particle size silica in the toner has a BET specific surface area of 50 $m^2/g$ to 400 $m^2/g$.

12. The image forming apparatus according to claim 11, wherein the latent image bearing member and at least one selected from the developing device, a charging device which charges the latent image bearing member, and a cleaning device which cleans a surface of the latent image bearing member after transfer of the toner image are integrally supported and formed as a process cartridge that is detachably mountable to an image forming apparatus main body.

13. The toner according to claim 6, wherein a bulk density of the toner is 0.41 $g/cm^3$ to 0.48 $g/cm^3$.

14. The toner according to claim 6, wherein in an amount of small particle size silica relative to toner base particles is 0.3% by mass to 1.8% by mass.

* * * * *